US009284108B2

(12) United States Patent
Middleton et al.

(10) Patent No.: US 9,284,108 B2
(45) Date of Patent: Mar. 15, 2016

(54) PLASMA TREATED SUSCEPTOR FILMS

(71) Applicant: Graphic Packaging International, Inc., Atlanta, GA (US)

(72) Inventors: Scott W. Middleton, Oshkosh, WI (US); Timothy H. Bohrer, Chicago, IL (US)

(73) Assignee: Graphic Packaging International, Inc., Atlanta, GA (US)

( * ) Notice: Subject to any disclaimer, the term of this patent is extended or adjusted under 35 U.S.C. 154(b) by 350 days.

(21) Appl. No.: 13/804,673

(22) Filed: Mar. 14, 2013

(65) Prior Publication Data

US 2013/0196041 A1 Aug. 1, 2013

Related U.S. Application Data

(63) Continuation-in-part of application No. 12/709,578, filed on Feb. 22, 2010, now abandoned.

(60) Provisional application No. 61/208,379, filed on Feb. 23, 2009.

(51) Int. Cl.

| | |
|---|---|
| ***H05B 6/64*** | (2006.01) |
| ***B65D 81/34*** | (2006.01) |
| ***B05D 3/14*** | (2006.01) |

(52) U.S. Cl.

CPC ..... *B65D 81/3446* (2013.01); *B05D 3/144* (2013.01); *H05B 6/6494* (2013.01); *B65D 2581/3466* (2013.01); *B65D 2581/3494* (2013.01)

(58) Field of Classification Search

CPC ..... B65D 81/3446; B65D 2581/3494; B65D 2581/3466; B05D 3/144; H05B 6/6494

USPC ..... 219/759, 725–735, 762, 678, 756; 428/34.3, 34.2, 35.7, 35.9, 40.2, 40.9; 426/107, 118, 234, 241, 243; 229/164.1, 87.08

See application file for complete search history.

(56) References Cited

U.S. PATENT DOCUMENTS

| | | | |
|---|---|---|---|
| 3,649,935 | A | 3/1972 | Low et al. |
| 3,676,809 | A | 7/1972 | Paine et al. |

(Continued)

FOREIGN PATENT DOCUMENTS

| | | | |
|---|---|---|---|
| DE | 2125978 | A1 | 5/1971 |
| EP | 0 755 776 | A1 | 1/1997 |

(Continued)

OTHER PUBLICATIONS

PCT/US2010/024857—International Preliminary Report on Patentability, Aug. 23, 2011, Graphic Packaging International, Inc.

(Continued)

*Primary Examiner* — Quang Van

(74) *Attorney, Agent, or Firm* — Womble Carlyle Sandridge & Rice, LLP

(57) ABSTRACT

A method of making a microwave energy interactive structure includes plasma treating the surface of a polymer film with an inert gas at a plasma treatment energy per unit surface area of the film of from about 0.005 J/cm$^2$ to about 0.2 J/cm$^2$ to reduce the apparent surface roughness of film the polymer film, and depositing a layer of microwave energy interactive material onto the plasma treated surface of the film.

14 Claims, 13 Drawing Sheets

(56) References Cited

U.S. PATENT DOCUMENTS

| | | | | |
|---|---|---|---|---|
| 3,967,998 | A | 7/1976 | Kane | |
| 3,997,701 | A | 12/1976 | Ealding et al. | |
| 4,042,569 | A | 8/1977 | Bell et al. | |
| 4,283,427 | A | 8/1981 | Winters et al. | |
| 4,851,632 | A | 7/1989 | Kaliski | |
| 4,866,235 | A | 9/1989 | Griffin et al. | |
| 4,894,503 | A | 1/1990 | Wendt | |
| 4,911,938 | A | 3/1990 | Fisher et al. | |
| 4,933,526 | A | 6/1990 | Fisher et al. | |
| 4,943,456 | A | 7/1990 | Pollart et al. | |
| 5,002,826 | A | 3/1991 | Pollart et al. | |
| 5,003,142 | A | 3/1991 | Fuller | |
| 5,006,684 | A | 4/1991 | Wendt et al. | |
| 5,039,001 | A | 8/1991 | Kinigakis et al. | |
| 5,118,747 | A | 6/1992 | Pollart et al. | |
| 5,124,388 | A | 6/1992 | Pruett et al. | |
| 5,126,519 | A | 6/1992 | Peleg | |
| 5,170,025 | A | 12/1992 | Perry | |
| 5,177,332 | A | 1/1993 | Fong | |
| 5,217,768 | A | 6/1993 | Walters et al. | |
| 5,300,746 | A | 4/1994 | Walters et al. | |
| 5,338,911 | A | 8/1994 | Brandberg et al. | |
| 5,405,663 | A | 4/1995 | Archibald et al. | |
| 5,410,135 | A | 4/1995 | Pollart et al. | |
| 5,412,187 | A | 5/1995 | Walters et al. | |
| 5,414,248 | A | 5/1995 | Phillips | |
| 5,439,961 | A | 8/1995 | Itoi et al. | |
| 5,519,196 | A | 5/1996 | Xu | |
| 5,527,413 | A | 6/1996 | Perry et al. | |
| 5,530,231 | A | 6/1996 | Walters et al. | |
| 5,571,627 | A | 11/1996 | Perry et al. | |
| 6,204,492 | B1 | 3/2001 | Zeng et al. | |
| 6,414,288 | B1 | 7/2002 | Bono et al. | |
| 6,433,322 | B2 | 8/2002 | Zeng et al. | |
| 6,528,144 | B2 | 3/2003 | Peiffer et al. | |
| 6,552,315 | B2 | 4/2003 | Zeng et al. | |
| 6,565,982 | B1 | 5/2003 | Ouderkirk et al. | |
| 6,677,563 | B2 | 1/2004 | Lai | |
| 6,805,952 | B2 | 10/2004 | Chang et al. | |
| 6,872,458 | B1 | 3/2005 | Rudd et al. | |
| 6,872,460 | B2 | 3/2005 | Murschall | |
| 7,019,271 | B2 | 3/2006 | Wnek et al. | |
| 7,081,286 | B2 | 7/2006 | Benim et al. | |
| 7,170,040 | B1 | 1/2007 | Benim et al. | |
| 7,351,942 | B2 | 4/2008 | Wnek et al. | |
| 7,368,165 | B2 | 5/2008 | Sankey et al. | |
| 7,524,920 | B2 | 4/2009 | Pecorini et al. | |
| 7,579,179 | B2 | 8/2009 | Bryhan et al. | |
| 7,601,408 | B2 | 10/2009 | Young et al. | |
| 8,642,935 | B2 * | 2/2014 | Robison et al. | 219/730 |
| 2001/0002024 | A1 | 5/2001 | Edwards | |
| 2001/0032843 | A1 | 10/2001 | Aronsson et al. | |
| 2002/0039235 | A1 | 4/2002 | Condo et al. | |
| 2003/0037882 | A1 | 2/2003 | Arita et al. | |
| 2003/0211243 | A1 | 11/2003 | Lohwasser et al. | |
| 2004/0000313 | A1 | 1/2004 | Gaynor et al. | |
| 2004/0004760 | A1 | 1/2004 | Oya et al. | |
| 2004/0126606 | A1 | 7/2004 | Arent et al. | |
| 2004/0175584 | A1 | 9/2004 | Yializis | |
| 2005/0019530 | A1 | 1/2005 | Merrill et al. | |
| 2005/0136202 | A1 | 6/2005 | Kendig et al. | |
| 2006/0096978 | A1 | 5/2006 | Lafferty et al. | |
| 2006/0193577 | A1 | 8/2006 | Ouderkirk et al. | |
| 2006/0232863 | A1 | 10/2006 | Nevitt et al. | |
| 2006/0272766 | A1 | 12/2006 | Hebrink et al. | |
| 2006/0289521 | A1 | 12/2006 | Bohme et al. | |
| 2007/0062936 | A1 | 3/2007 | Young et al. | |
| 2007/0084860 | A1 | 4/2007 | Corcoran, Jr. | |
| 2007/0131742 | A1 | 6/2007 | Fitzwater | |
| 2007/0131745 | A1 | 6/2007 | Fitzwater | |
| 2007/0145045 | A1 | 6/2007 | Middleton et al. | |
| 2007/0246460 | A1 | 10/2007 | Ford et al. | |
| 2008/0035634 | A1 | 2/2008 | Zeng et al. | |
| 2008/0078759 | A1 | 4/2008 | Wnek et al. | |
| 2008/0087664 | A1 | 4/2008 | Robison et al. | |
| 2008/0145666 | A1 | 6/2008 | Hebrink et al. | |
| 2008/0185310 | A1 | 8/2008 | Trajkovich | |
| 2008/0197128 | A1 | 8/2008 | Files et al. | |
| 2009/0011263 | A1 | 1/2009 | Forloni | |
| 2010/0003377 | A1 | 1/2010 | Brennan et al. | |
| 2010/0213191 | A1 | 8/2010 | Middleton | |
| 2010/0213192 | A1 | 8/2010 | Middleton | |
| 2010/0290117 | A1 | 11/2010 | Diehl et al. | |
| 2011/0011854 | A1 | 1/2011 | Middleton et al. | |
| 2013/0193135 | A1 | 8/2013 | Middleton et al. | |

FOREIGN PATENT DOCUMENTS

| | | | |
|---|---|---|---|
| EP | 0 844 519 | A1 | 5/1998 |
| JP | 7-506133 | | 7/1995 |
| JP | 09-199271 | | 7/1997 |
| JP | 2005-336382 | | 12/2005 |
| JP | 2007-529573 | | 10/2007 |
| JP | 2008-19005 | | 1/2008 |
| WO | WO 93/09945 | A1 | 5/1993 |
| WO | WO 93/12990 | | 7/1993 |
| WO | WO 93/19127 | | 9/1993 |
| WO | WO 96/06125 | | 2/1996 |
| WO | WO 01/38907 | A1 | 5/2001 |
| WO | WO 2005/087868 | A1 | 9/2005 |
| WO | WO 2007/127371 | | 8/2007 |
| WO | WO 2007/123611 | A1 | 11/2007 |
| WO | WO 2008/098156 | A1 | 8/2008 |
| WO | WO 2010/096736 | A2 | 8/2010 |
| WO | WO 2010/096740 | A2 | 8/2010 |
| WO | WO 2011/014630 | | 2/2011 |

OTHER PUBLICATIONS

PCT/US2010/024857—International Search Report and Written Opinion, Sep. 14, 2010, Graphic Packaging International, Inc.

PCT/US2010/024864—International Preliminary Report on Patentability, Aug. 23, 2011, Graphic Packaging International, Inc.

PCT/US2010/024864—International Search Report and Written Opinion, Sep. 14, 2010, Graphic Packaging International, Inc.

PCT/US2010/043677—International Preliminary Report on Patentability, Jan. 31, 2012, Graphic Packaging International, Inc.

PCT/US2010/043677—International Search Report and Written Opinion, May 31, 2011, Graphic Packaging International, Inc.

Gould et al., "Analysis of Poly(ethylene terephthalate) (PET) Films by Atomic Force Microscopy," 1997 John Wiley & Sons, Inc. CCC 0021-8995/97/071237-07, 1237-1243 (7 pp.).

Zuckerman et al., "Changes in Thin-Layer Susceptors During Microwave Heating," Packaging Technology and Science, vol. 7, 21-26 (1994) (6 pp.).

Bhushan et al., "Measurement of Surface Topography of Magnetic Tapes by Mirau Interferometry," Applied Optics, vol. 24, No. 10, 1489-1497 (May 15, 1985) (9 pp.).

Ramey et al., "Microwave Properties of Thin Films with Apertures," IEEE Transactions on Microwave Theory and Techniques, vol. MTT-18, No. 4, 196-204, Apr. 1970 (9 pp.).

Bobst Group, General Vacuum Equipment Ltd., "Plasma Pre-Treatment System" (2004) (2 pp.).

Cesnek, et al. "Properties of Thin Metallic Films for Microwave Susceptors," Czech J. Food Sci., vol. 21, No. 1, 34-40 (2003) (7 pp.).

Beake et al. "Scanning Force Microscopy Investigation of Poly(Ethylene Terephthalate) Modified by Argon Plasma Treatment," J. Mater. Chem., 1998, 8(8), 1735-1742 (8 pp.).

Inagaki et al., "Surface Characterization of Plasma-Modified Poly-(ethylene terephthalate) Film Surfaces," Journal of Polymer Science: Part B: Polymer Physics, vol. 42, 3727-3740 (2004) (14 pp.).

Esena et al., "Surface Modification of PET Film by a DBD Device at Atmospheric Pressure," Surface & Coatings Technology 200 (2005) 664-667 (4 pp.).

Ueda et al., "Surface Modification of Polyethylene Terephthalate by Plasma Immersion Ion Implantation," Surface & Coatings Technology 186 (2004) 295-298 (4 pp.).

Singh et al., "Surface Modification of Polyethylene Terephthalate by Plasma Treatment," Radiation Measurements 40 (2005) 746-749 (4 pp.).

(56) References Cited

OTHER PUBLICATIONS

Ramey et al., "The Thin Film Iris," Nasa Contractor Report CR-1364 (Jun. 1969) (37 pp.).
Hefflefinger et al., "A Survey of Film Processing Illustrated with Poly(Ethylene Terephthalate)," Polymer Engineering and Science, Nov. 1978, vol. 18, No. 15, 1163-1173 (11 pp.).
Turner, "Development of Amorphous Copolyesters Based on 1,4-Cyclohexanedimethanol," Journal of Polymer Science: Part A: Polymer Chemistry, vol. 42, pp. 5847-5852 (2004) (6 pp.).
Ionita et al., "Small size plasma tools for material processing at atmospheric pressure," Applied Surface Science, vol. 255, pp. 5448-5452 (2009) (available on-line Nov. 2008) (5 pp.).
Groning et al., "Plasma Modification of Polymethylmethacrylate and Polyethyleneterephthalate Surfaces," Journal of Applied Physics, vol. 76, Issue 2, Jul. 1994 (8 pp.).
Morelock et al., "AFM Studies of Corona-treated, Biaxially Oriented PET Film," Wright Converting Magazine, Dec. 1, 2007 (7 pp.).
Bobst Group, "Plasma Treatment" (2008) <http://www.bobstgroup.com/Global/Worldwide/en/FlexibleMaterials/Metallizing/PlasmaTreatment.htm>, printed on Feb. 17, 2009 (2 pages).
Hefflefinger et al, "Structure and Properties of Oriented Poly (ethylene Terephthalate) Films," Journal of Applied Polymer Science, vol. 9, 2261-2680 (1965).
Jabarin, "Crystallization Behavior of Poly(Ethylene Terephthalate)," Polymer Engineering and Science, Sep. 1989, vol. 29, No. 18, 1259-1264.
Jabarin, "Strain-Induced Crystallization of Poly(Ethylene Terephthalate)," Polymer Engineering and Science, Sep. 1992, vol. 32, No. 18, 1341-1349.
Varma et al. "Properties and Kinetics of Thermally Crystallized Oriented Poly(Ethylene Terephthalate) (PET), I: Kinetics of Crystallization," Polymer Engineering and Science, Feb. 1998, vol. 38, No. 2, 237-244.
Varma et al., "Properties and Kinetics of Thermally Crystallized Oriented Poly(Ethylene Terephthalate) (PET), II: Physical and Optical Properties," Polymer Engineering and Science, Feb. 1998, vol. 38, No. 2, 245-253.
Mody et al., "Shrinkage Behavior of Oriented Poly(ethylene terephthalate)," Society of Plastics Engineers, ANTEC Conference, 2000 (6 pp.).
Schmidt, "Polyethylene Terephthalate Structural Studies," Journal of Polymer Science: Part A, vol. 1, pp. 1271-1292 (1963).
Ajji et al., "Orientation and structure of drawn poly(ethylene terephthalate)," Polymer vol. 37, No. 16, 3707-3714 (1996).
Venkatraraman et al., "Orientation and Structure Development of Highly Crystalline and Clear Poly(Ethylene Terephthalate)," Society of Plastics Engineers, ANTEC Conference (1998) (7 pp.).
Ajji et al., "Orientation, Stress and Shrinkage Relationships for Amorphous and Semicrystalline Polymers," Society of Plastics Engineers, ANTEC Conference (1999) (5 pp.).
Ajji et al., "Correlations Between Orientation and Some Properties of Polymer Films and Sheets," Society of Plastics Engineers, ANTEC Conference (2002) (5 pp.).
Todorov et al., "Structure evolution of PET under step-wise and continuous deformation modes: the effect of stress relaxation on the strain-induced morphology," International Journal of Material Forming, vol. 1, Supplement 1, pp. 661-665, Apr. 2008.
Matthews et al., "The effects of stress relaxation on the structure and orientation of tensile drawn poly(ethylene terephthalate)," Polymer, vol. 41 pp. 7139-7145 (2000).
Kawakami et al., "Structural formation of amorphous poly(ethylene terephthalate) during uniaxial deformation above and below glass temperature," Society of Plastics Engineers, ANTEC Conference 2004, 1874-1978.
Liston et al., "Plasma surface modification of polymers for improved adhesion: a critical review," Journal of Adhesion Science and Technology, vol. 7, Issue 10, 1993, Abstract containing page and p. 8 only (2 pp.).
Ardelean et al., "Effects of different laser and plasma treatments on the interface and adherence between evaporated aluminium and polyethylene terephthalate films: X-ray photoemission, and adhesion studies," Applied Surface Science 243 (2005) 304-318 (15 pp.).
Brandup et al., Editors, "Polymer Handbook," 4th Edition, John Wiley & Sons (1999) p. V/113 (1 pp.).
DuPont Teijan Films, "Mylar 800 Product Information" (2007) (2 pp.).
Fakirov et al., "Unit Cell Dimensions of Poly(ethylene terephthalate)," Die Makromolekulare Chemie 176 (1975) 2459-2465.
Fischer et al., "Improvement of adhesion of Co—Cr layers by plasma surface modifications of the PET substrate," Journal of Adhesion Science and Technology, 8:2 (1994) 151-161.
Gruver et al., "The Determination of PET Crystallinity by Different Analytical Techniques," Society of Plastics Engineers, ANTEC 2000 Proceedings, 1636-1640.
Jonghan et al., "The Effect of Blend Composition and Draw Ratio on the Thermal, Optical, and Mechanical Properties in PET/PEI Films," published by the Society of Plastics Engineers in ANTEC 1999 Proceedings, paper No. 288 (6 pp.).
Kiihamaki et al., "Depth and profile control in plasma etched MEMS structures," Sensors and Actuators 82 (2000) 234-238.
Kong et al., "The measurement of the crystallinity of polymers by DSC," Polymer 43 (2002) 3873-3878.
Liston et al., "Plasma surface modification of polymers for improved adhesion: a critical review," Journal of Adhesion Science and Technology, vol. 7, Issue 10 (1993) 1091-1127.
Mehta et al., "Equilibrium Melting Parameters of Poly(ethylene Terephthalate)," Journal of Polymer Science: Polymer Physics Edition, vol. 16, 289-296 (1978).
Michigan Metrology, LLC, "3D S Height (Amplitude) Parameters: Sa and Sq" <http://www.michmet.com/3d_s_height_parameters_sasq.htm> (printed Mar. 9, 2013) (1 pp.).
Michigan Metrology, LLC, "3D S Hybrid Parameters: Sdq" <http://www.michmet.com/3d_s_hybrid_parameters_sdq.htm> (printed Mar. 9, 2013) (1 pp.).
Mitsubishi Polyester Film, "Hostaphan RD and RD 26HC," Edition May 2008 (3 pp.).
Nuroll SpA, "Transparent FXE Provisional Data Sheet," (Dec. 2007) (3 pp.).
Toray Plastics (America), Inc., Lumirror F65 Technical Data Sheet (2009) (1 pp.).
Toray Plastics Europe SA, "Lumirror 10.12 Polyester Film" (Oct. 2005) (2 pp.).
Wunderlich, B. Macromolecular Physics, Academic Press, New York, 1973, vol. 1, 380-408.
Volland et al, "The application of secondary effects in high aspect ratio dry etching for the fabrication of MEMS," Microelectronic Engineering 57-58 (2001) 641-650.
Zuckerman et al., "Characterization of Thin Layer Susceptors for the Microwave Oven," Journal of Food Processing and Preservation 16 (1992) 193-204.
U.S. Appl. No. 12/709,628, Office Action dated May 18, 2012.
U.S. Appl. No. 12/709,628, Response filed Aug. 15, 2012.
U.S. Appl. No. 12/709,628, Office Action dated Sep. 24, 2012.
U.S. Appl. No. 12/709,628, Response filed Oct. 9, 2012.
U.S. Appl. No. 12/709,628, Office Action dated Nov. 30, 2012.
U.S. Appl. No. 12/709,628, Response filed Mar. 28, 2013.
JP Patent Application No. 2011-551264, Notification of Reason for Rejection dated Dec. 18, 2012 (with partial English translation).
Declaration of Scott Middleton and Tim Bohrer Under 37 CFR 1.132, U.S. Appl. No. 12/709,628, dated Mar. 25, 2013.
Supplementary European Search Report for EP 10 74 4420 dated Mar. 10, 2014.
Supplementary European Search Report for EP 10 80 5035 dated Mar. 11, 2014.
Office Action for U.S. Appl. No. 12/709,628, dated Mar. 13, 2014.
Request for Continued Examination (RCE) Transmittal and Amendment and Response for U.S. Appl. No. 12/709,628 dated Jun. 11, 2014.
Office Action for U.S. Appl. No. 12/709,628 dated Jan. 23, 2015.
Response for U.S. Appl. No. 12/709,628 filed Apr. 22, 2015.
Office Action for U.S. Appl. No. 12/709,628 dated Jun. 4, 2015.
U.S. Appl. No. 12/846,159, Office Action dated Jun. 28, 2013.

(56) References Cited

OTHER PUBLICATIONS

U.S. Appl. No. 12/846,159, Response dated Sep. 19, 2013.
U.S. Appl. No. 12/846,159, Office Action dated Oct. 4, 2013.
U.S. Appl. No. 12/846,159, Response dated Feb. 4, 2014.
U.S. Appl. No. 12/846,159, Office Action dated Mar. 26, 2015.
Wahit et al., "Morphology, Thermal, and Mechanical Behavior of Ethylene Octene Copolymer Toughened Polyamide 6/Polypropylene Nanocomposites," Journal of Thermoplastic Composite Materials, Sep. 2006, vol. 19, No. 5, pp. 545-567.
http://www.worldofplastic.net/PolyethyleneTerephthalate.htm.
International Search Report and Written Opinion for PCT/US2013/031425 dated Dec. 24, 2013.
International Search Report and Written Opinion for PCT/US2013/031420 dated Dec. 24, 2013.
Wahit et al., Ethylene-Octene Copolymer (POE) Toughened Polyamide 6/Polypropylene Nanocomposites: Effect of PEO Maleation, eXPRESS Polymer Letters, vol. 3., No. 5 (2009) pp. 309-319.
U.S. Appl. No. 12/709,628, Request for Continued Examination (RCE) Transmittal dated Sep. 3, 2015.
U.S. Appl. No. 12/709,628, Amendment and Response dated Sep. 3, 2015.
U.S. Appl. No. 12/846,159, Amendment Under 37 C.F.R. § 1.111 dated Jul. 22, 2015.
U.S. Appl. No. 12/846,159, Declaration under 37 C.F.R. 1.132 of Timothy H. Bohrer dated Jul. 20, 2015.

* cited by examiner

PLASMA TREATED SUSCEPTOR FILMS

CROSS-REFERENCE TO RELATED APPLICATIONS

This application is a continuation-in-part of U.S. patent application Ser. No. 12/709,578, filed Feb. 22, 2010, which claims the benefit of U.S. Provisional Application No. 61/208,379, filed Feb. 23, 2009, both of which are incorporated by reference in their entirety.

BACKGROUND

Susceptors are often used in microwave heating packages to enhance the browning and/or crisping of an adjacent food item. A susceptor is a thin layer of microwave energy interactive material (e.g., generally less than about 500 angstroms in thickness, for example, from about 60 to about 100 angstroms in thickness, and having an optical density of from about 0.15 to about 0.35, for example, about 0.17 to about 0.28), for example, aluminum, that, when exposed to microwave energy, tends to absorb at least a portion of the microwave energy and convert it to thermal energy (i.e., heat) through resistive losses in the layer of microwave energy interactive material. The remaining microwave energy is either reflected by or transmitted through the susceptor.

As shown schematically in FIG. 1, the layer of microwave energy interactive material (i.e., susceptor) 102 is typically supported on a polymer film 104 to define a susceptor film 106. In most conventional susceptor films, the polymer film comprises biaxially oriented, heat set polyethylene terephthalate, but other films may be suitable. The susceptor film is typically joined (e.g., laminated) to a support layer 108, for example, paper or paperboard, using an adhesive or otherwise, to impart dimensional stability to the susceptor film and to protect the layer of metal from being damaged. The resulting structure 110 may be referred to as a "susceptor structure".

It is known that susceptor structures exhibit "self-limiting" behavior, that is, upon sufficient exposure to microwave energy, the susceptor film reaches a certain temperature and begins to form a crack or line of crazing. While not wishing to be bound by theory, it is believed that this crack or line of crazing propagates along a line of least electrical resistance through the conductive layer. As the crazing progresses and the cracks intersect one another, the network of intersecting lines subdivides the plane of the susceptor into progressively smaller conductive islands. As a result, the overall reflectance of the susceptor decreases, the overall transmission increases, and the amount of energy converted into sensible heat decreases.

This self-limiting behavior may be advantageous in particular heating applications where runaway heating of the susceptor would otherwise cause excessive charring or scorching of the food item and/or any supporting structures or substrates, for example, paper or paperboard. However, in other applications, it may desirable to limit or delay this behavior to ensure that the susceptor generates sufficient heat to be transferred to the adjacent food item to achieve the desired level of heating, browning, and/or crisping.

The present inventors postulated that since the layer of microwave energy interactive material is extremely thin, the performance of a susceptor may be highly sensitive to imperfections on the surface of the film, with a smoother polymer film surface providing greater heating longevity, and a rougher polymer film surface accelerating the self-limiting behavior of the susceptor structure. The present inventors further postulated that the topography of the polymer film could be tailored to control the rate and degree of crazing, and therefore, the self-limiting behavior, of a susceptor structure.

Standard biaxially oriented, heat set PET films typically used to form susceptor films have surface structures (e.g., strain-induced crystalline lamella and other surface features). Such structures generally cause the surface of the film to be rough and/or irregular. In some cases, the peak to trough surface roughness may be from about 40 to about 100 nanometers or greater. Therefore, when microwave energy interactive material is deposited using vacuum vapor deposition onto the surface of the polymer film by line of sight travel from the metal source, it typically does not form a uniform layer. Instead, the microwave energy interactive material is non-uniformly deposited on the surface with some areas having more and some areas less or even no deposition of microwave energy interactive material. As a result, the conversion of microwave energy into sensible heat is likewise non-uniform. While not wishing to be bound by theory, it is believed that complex resistive-capacitive circuits are formed in the conductive layer, with the areas completely or nearly void of conductive aluminum acting as capacitors. The routing of electrical current throughout the polymer film may be preferentially channeled to the paths (or circuits) of lowest resistance. The $I^2R$ power loss in low resistance circuits exceeds the power loss in immediately adjacent areas of higher resistance. As a result, low resistance circuits heat the biaxially oriented, heat set PET film above its heat set temperature, and the resulting orientation stress relief causes a crack to form in the film.

Plasma treatment has been widely used in a variety of applications for altering the surface of polymer films. While there are many forms and uses for subjecting materials to plasmas, plasma treatment generally consists of exposing the surface of a film to a glow discharge. The resulting plasma is a partially ionized gas consisting of large concentrations of excited atomic, molecular, ionic, and free-radical species. Excitation of the gas molecules is accomplished by subjecting the gas, which in the present invention is enclosed in a vacuum chamber, to an electric field, typically generated by the application of radio frequency (RF) energy. Free electrons gain energy from the imposed RF electric field, colliding with neutral gas molecules and transferring energy, dissociating the molecules to form numerous reactive species. It is the interaction of these excited species with films placed in the plasma that results in the chemical and physical modification of the film surface.

In many instances, the plasma treatment conditions are selected for the polymer film to provide a roughening of the surface that allows the film to receive other materials. For example, Ionita et al. (Ionita, R, M. D., Stancu, E. C., Teodorescu, M., Dinescu, G., "Small size plasma tools for material processing at atmospheric pressure", Applied Surface Science 255 (2009) 5448-5482) exposes films to an argon plasma of 14 W power delivered by an 8 mm diameter probe traversing the film sample at 5 mm/s in ambient atmosphere (14 W, 0.2 s exposure/$mm^2$, yielding 2.8 J/$mm^2$ per pass or 14 J/$mm^2$ or 1400 J/$cm^2$ per 5 passes) (p. 5449). As another example, U.S. Pat. No. 7,579,179 to Bryhan et al. describes a plasma treatment up to 800 J/$cm^2$ intended to significantly roughen surfaces to enhance biological cell growth and cell attachment. A large list of gases is described, some of which were applied at extremely high applied power to create significant roughness.

Plasma treatment has also been done under conditions in which little or no surface roughening occurred. For example, Beake et al. (Beake, B. D., Ling, J. S. G., Leggett, G. J., "Scanning force microscopy investigation of poly(ethylene terephthalate) modified by argon plasma treatment", Journal of Materials Chemistry, 8(8) (1998) 1735-1742), biaxially oriented PET film was exposed to argon plasma at 0.1 mbar, 10 W power for 1, 10, 20, 60 and 90 minutes. Despite the clear differences in type of topography seen in FIGS. 2 and 3 of the article, the authors state "The topographical changes resulting from plasma treatment were not accompanied by a change in surface roughness, as measured by the variance of the RMS height of the surface features, which remained constant . . . very close to the value determined for the untreated Melinex 'O'." Beake et al. also report that in addition to their own experiments, Fischer et al. "have reported scanning electron microscopy (SEM) data showing that whilst oxygen plasma roughens the PET surface, argon plasma does not" (Fischer, G., Haeneyer, A., Dembowski, J., Hibst, H., "Improvement of adhesion of Co—Cr layers by plasma surface modifications of the PET substrate", *J. Adhes. Sci. Technol.,* 8 (1994) 151, see FIG. 2 showing that after 10 min etching time arithmetic mean roughness remained essentially the same as that of the untreated film).

Amanatides et al. (Amanatides, E., Mataras, D., Katsikogianni, M., Missirlis, Y. Y., "Plasma surface treatment of polyethylene terephthalate films for bacterial repellence", Surface & Coatings Technology, 100 (2006) 6331-6335) report on average surface roughness changes after 15 minutes etching time using 80% He/20% $O_2$ gas at 45.7 J/cm$^2$ that "the PET films treated under negative bias have lower surface roughness compared to the ones treated with no bias" (see p. 6334).

Ardelean et al. (Ardelean, H., Petit, S., Laurens, P., Marcus, P., Arefi-Khonsari, F., "Effects of different laser and plasma treatments on the interface and adherence between evaporated aluminum and polyethylene terephthalate films: X-ray photoemission, and adhesion studies", Applied Surface Science 243 (2005) 304-318) exposed PET films to 95% He/5% $O_2$ plasma at a plasma treatment energy of 0.2 J/cm$^2$ and report that at those conditions "the surface topography of the plasma treated surface showed no difference with the non-treated polymer" (p. 311).

Liston et al. (Liston, E. M., Martinu, L., Wertheimer, M. R., "Plasma surface modification for improved adhesion: a critical review", *J. Adhesion Sci. Technol.* 7 (10) (1993) 1091-1127) state on p. 1097, "For example, plasma surface treatment of fluoropolymers for short times improves their wettability without modifying their surface texture, but over-treatment gives a very porous surface [27, 28*]. The same is true for polyethylene terephthalate* (*PET*)[29]." (where Reference 29 is Y.-L. Hsieh, D. A. Timm and M. Wu, J. Appl. Polym. Sci. 38, 1719-1737 (1989)).

It has also been recognized that plasma treatment may result in non-uniform ablation of topographical surface features, depending on the specific surface features and geometry of the film being treated. This phenomenon has been studied particularly in the area of MEMS (microelectromechanical systems). See, e.g., Volland, B. E., Heerlein, H., Kostic, I. and Rangelow, I. W., "The application of secondary effects in high aspect ratio dry etching for the fabrication of MEMS", Microelectronic Engineering, 57-58 (2001) 641-650, and Kiihamaki, J., Kattelus, H., Karttunen, J., Franssila, S., "Depth and profile control in plasma etched MEMS structures", Sensors and Actuators, 82 (2000) 234-238. As the authors indicate, several secondary effects are well known in plasma etching for MEMS fabrication—reactive ion etch lag (RIE-lag, small features etch slower than large features) and aspect ratio dependent etching (ARDE, greater aspect ratios of features create increasing shadowing effects, reducing etching rates in areas bounded by the features). Both impact uniformity of etch rates and hence material removal and thus impact the results of etching processes.

There is a continuing need for susceptor films that exhibit the desired level of crazing, and therefore, desired level of heating for a particular application. Although some attempts to understand the self-limiting behavior of susceptors have been made, the relationship between the surface characteristics of oriented films used for microwave susceptor films and the resulting susceptor performance has generally not been explored or understood. The present inventors have discovered that plasma treatment of films may be used to modify the behavior of susceptors to attain these desired properties. Various aspects, features, and embodiments will be apparent from the following description and accompanying figures.

SUMMARY

This disclosure is directed generally to a polymer film (or simply "film") for use in a susceptor film, a method of making such a polymer film, and a susceptor film including the polymer film. The susceptor film may be joined to a support layer to form a susceptor structure. The susceptor film and/or susceptor structure may be used to form countless microwave energy interactive structures, microwave heating packages, or other microwave energy interactive constructs.

The surface of the film is plasma treated prior to depositing the microwave energy interactive material on the film. In one aspect, a relatively low energy and/or relatively short exposure plasma treatment may be used to reduce the apparent surface roughness of the film. While not wishing to be bound by theory, it is believed that a relatively low energy and/or relatively short exposure plasma treatment may be used to preferentially remove a meaningful fraction of the sharpest, tallest topographical features or "spires" from the surface of the film. While the shape and dimensions of these narrow, tall features may vary, the spires may generally have an aspect ratio (height to diameter or width) of at least about 5:1, as determined using atomic force microscopy (AFM) or any other suitable technique.

It is believed that a high concentration of these narrow, tall features or spires may tend to interrupt the ion flow to adjacent areas (the ions do not all move on normal paths from the source to the substrate), preferentially eroding and even removing spires of sufficiently high aspect ratios. By eroding or removing such spires, the microwave energy interactive material may be applied more uniformly. Additionally, the layer of microwave energy interactive material may have fewer defects, which may typically be caused by the protrusion of such spires through the layer of microwave energy interactive material. As a result, the onset of crazing is delayed and the efficacy of the resulting susceptor structure is improved.

DESCRIPTION

Figure 1:
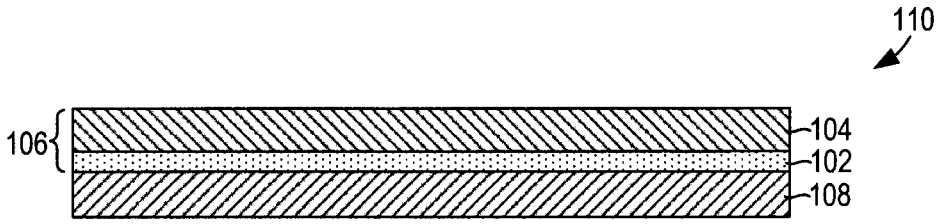
FIG. 1 is a schematic cross-sectional view of an exemplary microwave energy interactive structure.

Various plasma treatment conditions may be suitable for forming susceptor films according to the disclosure. Those of skill in the art will recognize that the precise treatment conditions used will depend on a variety of factors, including the particular film being used, whether any additives are present, and so on. Thus, the following discussion of plasma treatment conditions is for illustrative purposes only and should not be construed as being limiting in nature.

As stated above, a relatively low energy and/or relatively short exposure plasma treatment may be used to reduce the apparent surface roughness of the film. Notably, the plasma treatment energy is significantly less, and the exposure time is significantly shorter, than conventional plasma treatment conditions used for etching or surface preparation. Accordingly, it will be understood that power levels above the optimum level for a particular combination of gas/gases and film and/or excessive exposure times may actually increase surface roughness through etching of portions of the film. For example, while not wishing to be bound by theory, it is believed that excessive treatment can erode the amorphous regions of the film, thereby creating rough areas and/or exposing pre-existing morphological features of the film.

Additionally, while not wishing to be bound by theory, it is also believed that the plasma treatment may cause a surface activation or chemical modification of the polymer film, which also may provide a more uniform deposition and a more uniform assembly of the crystalline structure of the microwave energy interactive material on the surface of the film.

The applied power may be selected so that the plasma treatment energy may be less than about 0.2 J/cm$^2$. In some specific examples, the plasma treatment energy may be less than about 0.19 J/cm$^2$, less than about 0.18 J/cm$^2$, less than about 0.17 J/cm$^2$, less than about 0.16 J/cm$^2$, less than about 0.15 J/cm$^2$, less than about 0.14 J/cm$^2$, less than about 0.13 J/cm$^2$, less than about 0.12 J/cm$^2$, about 0.11 J/cm$^2$, less than about 0.10 J/cm$^2$, less than about 0.09 J/cm$^2$, less than about 0.08 J/cm$^2$, less than about 0.07 J/cm$^2$, less than about 0.06 J/cm$^2$, less than about 0.05 J/cm$^2$, less than about 0.04 J/cm$^2$, about 0.03 J/cm$^2$, less than about 0.02 J/cm$^2$, less than about 0.01 J/cm$^2$, less than about 0.009 J/cm$^2$, less than about 0.008 J/cm$^2$, less than about 0.007 J/cm$^2$, less than about 0.006 J/cm$^2$, less than about 0.005 J/cm$^2$, less than about 0.004 J/cm$^2$, less than about 0.003 J/cm$^2$, less than about 0.002 J/cm$^2$, or less than about 0.001 J/cm$^2$. In other specific examples, the plasma treatment energy may be from about 0.005 J/cm$^2$ to about 0.15 J/cm$^2$, from about 0.008 J/cm$^2$ to about 0.1 J/cm$^2$, from about 0.01 J/cm$^2$ to about 0.07 J/cm$^2$, from about 0.02 J/cm$^2$ to about 0.05 J/cm$^2$, or from about 0.027 J/cm$^2$ to about 0.041 J/cm$^2$. However, other levels of plasma treatment energy may be used where needed to provide the desired balance between erosion of undesirable protrusions and excessive etching of amorphous regions or even creation of new protrusions.

The plasma treatment may be conducted using argon, nitrogen, carbon dioxide, helium, oxygen, air, fluorine, or any combination thereof. However, numerous other plasma treatment gases and mixtures thereof may be suitable. It will be appreciated that the selection of a treatment gas and applied power may depend on the surface characteristics of the film prior to treatment, and more particularly, on the concentration of high aspect ratio (e.g., at least about 5:1) surface features or spires that are readily eroded. When fewer of these features present, a less energetic plasma (combination of power, exposure time and species) may be used to minimize erosion of amorphous surface components if higher food browning performance is desired, as excessive amorphous erosion may translate into increased apparent surface roughness and decreased food surface browning (see Example 1). By way of example, where the surface of film has a large number of high aspect ratio spires, argon may be a suitable plasma treatment gas. Alternatively, for films with fewer or even no high aspect spires, it may be desirable to use a more gentle treatment gas, such as nitrogen. However, countless other possibilities are contemplated.

The plasma exposure time may generally be less than about 3 ms. In some specific examples, the exposure time may be less than about 2.9 ms, less than about 2.8 ms, less than about 2.7 ms, less than about 2.6 ms, less than about 2.5 ms, less than about 2.4 ms, less than about 2.3 ms, less than about 2.2 ms, less than about 2.1 ms, less than about 2.0 ms, less than about 1.9 ms, less than about 1.8 ms, less than about 1.7 ms, less than about 1.6 ms, less than about 1.5 ms, less than about 1.4 ms, less than about 1.3 ms, less than about 1.2 ms, less than about 1.1 ms, less than about 1.0 ms, less than about 0.9 ms, less than about 0.8 ms, less than about 0.7 ms, less than about 0.6 ms, or less than about 0.5 ms. However, other treatment times may be suitable for some applications.

Notably, the applied power (and therefore plasma treatment energy per unit area) and exposure times described herein result in a far more gentle plasma treatment than is conventionally used for surface preparation applications. This gentle treatment is needed to remove high aspect ratio features from the surface of the film without allowing too much energy to work detrimentally on the surface of the film. For example, typical prior art exposure times range from 0.5 s to greater than 90 s, which results in a energy intensity (applied power level per unit area multiplied by exposure time) that is between 6 and >10,000 times greater (see e.g., Ionita el., Bryhan et al., and Amanatides et al. referenced in the Background) than the energy intensity used by the present inventors under the plasma treatment conditions described in the Examples.

The plasma treatment may be conducted inline with the deposition of the microwave energy interactive material. The plasma treatment and metallization may be conducted in a closed chamber maintained at vacuum pressures. For example, the metallization may be conducted at a pressure of less than about $5\times10^{-4}$ torr. In some specific examples, the pressure may be less than about $5\times10^{-4}$ torr, less than about $4\times10^{-4}$ torr, less than about $3\times10^{-4}$ torr, less than about $2\times10^{-4}$ torr, less than about $1\times10^{-4}$ torr, less than about $9\times10^{-5}$ torr, less than about $8\times10^{-5}$ torr, less than about $7\times10^{-5}$ torr, less than about $6\times10^{-5}$ torr, or less than about $5\times10^{-5}$ torr. However, other plasma treatment pressures may be suitable in some instances.

Various films may be suitable for forming susceptor films according to the disclosure. It will be appreciated that there can be great variability in oriented films due to the large number of variables in the polymer, any additives, and process conditions by which the film is made. Some of such variables may include, but are not limited to, the presence of additives that influence the kinetics of crystallization, the achievable crystallinity of the polymer (including via modifications through incorporation of additives or co-monomers), the rate of orientation in the machine direction (MD) and transverse direction (TD), the degree of MD and TD orientation, the temperature, dwell time, and applied tension of heat setting, the temperature of orientation, the presence, concentration, and/or particle size of additives that increase surface roughness (e.g., anti-blocking agents), low molecular weight oligomers that have migrated to the film surface, or any deposition of debris or particle contamination on the film surface prior to metal deposition, the presence of surface scratches or other defects resulting from the manufacturing process, and/or any other variable. Accordingly, it will be appreciated that each film may respond differently to plasma treatment (or other treatments) with varying degrees of smoothing; as with any chemical or mechanical process, one would logically expect to find conditions of overtreatment that generate effects opposite to those intended, with some undesirable combinations of film, plasma gas/gases, and applied power resulting in increased roughness. Likewise, the reduction in roughness of one film may result in a greater improvement in heating performance than another film.

Nonetheless, for illustrative purposes only, some suitable PET films may be characterized as having one or more of the following:

1. A significant presence of high aspect ratio (e.g., at least about 5:1) surface features or spires, as determined using atomic force microscopy (AFM) or any other suitable technique. As stated above, it is believed that these spires may tend to interrupt the ion flow to adjacent areas, preferentially eroding and even removing spires of sufficiently high aspect ratios.

2. A crystallinity of at least about 45% (or density of 1.388, as measured as described in Example 1). In some specific examples, the crystallinity may be at least about 46%, at least about 47%, at least about 48%, at least about 49%, at least about 50%, at least about 51%, at least about 52%, at least about 53%, at least about 54%, or about 55%. While not wishing to be bound by theory, it is believed that films having a crystallinity of at least about 45% will have a high propensity for exhibiting high aspect ratio surface features or spires which may be amenable for removal by plasma treatment.

3. A differential scanning calorimetry (DSC) initial heating melting endotherm of at least about 39 J/g. In some specific examples, the initial heating melting endotherm may be at least about 40 J/g, at least about 41 J/g, at least about 42 J/g, at least about 43 J/g, at least about 44 J/g, at least about 45 J/g, at least about 46 J/g, or at least about 47 J/g. While not wishing to be bound by theory, it is believed that films having an initial heating melting endotherm of at least about 39 J/g have been subjected to sufficient orientation and heat setting to develop high aspect ratio surface features or spires which may be amenable for removal by plasma treatment.

4. A high degree of orientation and heat setting in both the machine direction and transverse direction. For example, the degree of stretch during the orienting process may be from about 3.5:1 to about 4:1 in the machine direction (MID) and from about 3.5:1 to about 4:1 in the transverse direction (TD). For example, films that have been heat set sufficiently will develop crystallinity to a degree that they have a high propensity for exhibiting surface features which may be amenable for removal by plasma treatment and also exhibit sufficient thermal stability to shrink less than about 3% in either MD and TD after unrestrained exposure to about 150° C. for about 30 minutes (ASTM D1204). While not wishing to be bound by theory, it is believed that films having a high degree of orientation and heat setting in both the machine direction and transverse direction will have high propensity for exhibiting high aspect ratio surface features or spires which may be amenable for removal by plasma treatment yielding.

5. An oligomer content of less than about 3.5 wt % (as measured by extraction with chloroform at room temperature for about 8 hours). In some specific examples, the film may have an oligomer content of less than about 3.0 wt %, less than about 2.5 wt %, less than about 2.0 wt %, less than about 1.5 wt %, or less than about 0.5 wt %. While not wishing to be bound by theory, it is believed that films having a higher oligomer content may have a substantial presence of low molecular weight oligomers on the surface that may interfere with the reduction of surface structures such as spires or the proper activation of the surface for vapor metal deposition using plasma treatment. For example, it is believed that when excessive oligomers are present, the action of impinging ions during plasma treatment may be to either volatilize the low molecular weight molecules using energy that could otherwise remove surface structures or properly activate the surface, or graft the oligomers to the existing crystalline surface structure, thereby creating protrusions that increase the apparent surface roughness of the film.

6. A thermal stability in the transverse direction (TD) of less than about 3% shrink at 150° C. for 30 min. (as measured by ASTM D1204). In some specific examples, the film may have a thermal stability in the transverse direction of less than about 2.8%, less than about 2.6%, less than about 2.4%, less than about 2.2%, less than about 2.0%, less than about 1.8%, less than about 1.6%, less than about 1.4%, less than about 1.2%, less than about 1.0%, less than about 0.8%, less than about 0.6%, less than about 0.4%, less than about 0.2%, or 0% shrink at 150° C. for 30 min. While not wishing to be bound by theory, it is believed that films having a thermal stability in the transverse direction of less than about 3% shrink at 150° C. for 30 min. have received sufficient heat setting to develop a level of crystallinity associated with a propensity to exhibit high aspect ratio surface features or spires which may be amenable to removal by plasma treatment.

7. A haze of less than about 4% (ASTM D1003). In some specific examples, the film may have a haze of less than about 3.5%, less than about 3.0%, less than about 2.5%, less than about 2.0%, less than about 1.5%, or less than about 0.5%. While not wishing to be bound by theory, it is believed that film clarity indicates an absence of particulate additives or fillers that may interfere with plasma treatment.

Examples of PET films exhibiting one or more of these characteristics include, but are not limited to, DuPont Teijin Films Mylar® 800, DuPont Teijin Films Melinex® HS2, Toray Lumirror® F65, and Toray Lumirror® 10.12. However, other PET films may be suitable.

Moreover, even though the use of PET films is described in detail herein, it will be appreciated that other films may be suitable for the present inventions. While some of the above parameters are polymer (e.g., polyethylene terephthalate or PET) specific (e.g., nos. 3 and 6), it will be appreciated that the remaining parameters and the general principles disclosed herein regarding plasma treatment of films for use in susceptor films may be used to select appropriate films and/or process conditions for forming high performance susceptors. Examples of films that may be suitable include, but are not limited to films comprising copolyesters, acrylonitrile, polysulfones, polyethylene naphthalate (PEN), polybutylene terephthalate (PBT), and any copolymer or blends thereof.

As stated above, plasma treatment reduces the apparent surface roughness of the film so that a more uniform deposition of vapor deposited metal can be attained. A more uniform deposition may convert microwave energy to sensible heat more uniformly with fewer lines of crazing and a lower rate of craze formation. As a result, the peak temperature reached by the susceptor may increase while still retaining a desirable level of self-limiting behavior.

In some embodiments, the plasma treatment may reduce the apparent surface roughness of the film by at least 10%, at least 15%, at least 20%, at least 25%, at least 30%, at least 35%, at least 40%, at least 45%, at least 50%, at least 55%, at least 60%, at least 65%, at least 70%, at least 75%, at least 80%, or any other amount. In other embodiments, the plasma treatment may reduce the apparent surface roughness of the film from about 10% to about 80%, from about 15% to about 60%, from about 20% to about 50%, from about 25% to about 35%, or any other range of amounts. In some particular examples, the plasma treatment may reduce the apparent surface roughness of the film about 26%, about 26.6%, about 32%, or about 32.3%.

The change in apparent surface roughness may be measured or characterized in a variety of ways. In one example, the apparent surface roughness may be characterized using a dimensionless parameter, perimeter divided by edge length (PEL), which represents the total perimeter of topographic features penetrating a horizontal plane of a defined height within a square sample area, divided by the length of a single edge of the square sample area (e.g., using atomic force microscopy (AFM) or any other suitable technique).

The present inventors have discovered that the perimeter divided by edge length (PEL) value can be correlated to a change in the degree of browning and crisping of an adjacent food item when these films are used to form susceptor films. For example, for metallized films that were plasma pretreated in-line with vacuum deposition of standard susceptor level aluminum, it has been shown that food browning performance of susceptor structures generally decreases with increasing perimeter divided by edge length (PEL) 120 values, and that food browning performance of susceptor structures generally increases with decreasing perimeter divided by edge length (PEL) 120 values. Thus, the perimeter divided by edge length (PEL) value can be used to predict how a particular plasma treated metallized film will perform in a susceptor structure.

It is noted that although RMS (mathematical Root Mean Square, which is an average of peaks and valleys of a surface) and Ra (average roughness) are a commonly used measurements for characterizing and comparing surface roughness, the perimeter divided by edge length (PEL) parameter was found to be more capable of differentiating clearly different surfaces. For example, RMS was unable to adequately characterize the observed phenomena and was unable to predict clear differences in visual appearance of AFM scans of metallized film surfaces with and without plasma pretreatment. The inability of RMS to differentiate topographies that have quite different visual appearances has also been noted in the literature. For example, Beake et al, (Beake, B. D., Ling, J. S. G., Leggett, G. J., "Scanning force microscopy investigation of poly(ethylene terephthalate) modified by argon plasma treatment", Journal of Materials Chemistry, 8(8) (1998) 1735-1742) investigates surface topography changes and presents detailed evidence of the failure of RMS to adequately characterize surface differences.

Moreover, reducing the description of surface roughness to RMS or Ra fails to fully describe other aspects of surface topography that may be relevant. For example Liston et al. (Liston, E. M., Martinu, L., Wertheimer, M. R.; "Plasma surface modification for improved adhesion: a critical review", *J. Adhesion Sci. Technol.* 7 (10) (1993) 1091-1127), in describing ablation or etching of material from the surface as one of the four major effects of plasmas, indicate that these are effects "which can remove a weak boundary layer and increase the surface area".

One skilled in the art of describing the characteristics of surfaces by RMS, for example, understands that surface roughness described by this parameter and absolute surface area per unit area of a film are two different parameters and do not necessarily move in tandem. Michigan Metrology (experts in measuring surface roughness) (www.michmet.com, under the Texture Parameters tab) points out (note they use Sq as the symbol for RMS roughness and Sa as the symbol for average roughness) that "The Sa and Sq parameters represent an overall measure of the texture comprising the surface. Sa and Sq are insensitive in differentiating peaks, valleys and the spacing of the various texture features. Thus Sa or Sq may be misleading in that many surfaces with grossly different spatial and height symmetry features (e.g., milled vs. honed) may have the same Sa or Sq, but function quite differently." Examples shown of applications for this and other parameters show clearly that surface area and standard roughness parameters can be quite independent of each other.

For at least these reasons, the perimeter divided by edge length (PEL) 120 parameter is used herein to describe changes in apparent surface roughness of films. However, the present invention should not be construed as limited to the use of this parameter or technique where other suitable methods may be used.

After plasma surface modification, a layer of microwave energy interactive material (i.e., a microwave susceptible coating or susceptor) may be deposited on the film to form a susceptor film. The microwave energy interactive material may be an electroconductive or semiconductive material, for example, a vacuum deposited metal or metal alloy, or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). Notably, ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric.

Artificial dielectrics comprise conductive, subdivided material in a polymeric or other suitable matrix or binder, and may include flakes of an electroconductive metal, for example, aluminum.

In other embodiments, the microwave energy interactive material may be carbon-based, for example, as disclosed in U.S. Pat. Nos. 4,943,456, 5,002,826, 5,118,747, and 5,410,135.

In still other embodiments, the microwave energy interactive material may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

If desired, the susceptor film may be laminated to another material to produce a susceptor structure for use in forming a microwave heating package or other construct. For example, the susceptor film may be laminated, to a paper or paperboard support that may impart dimensional stability to the structure. The paper may have a basis weight of from about 15 to about 60 lb/ream (lb/3000 sq. ft.), for example, from about 20 to about 40 lb/ream, for example, about 25 lb/ream. The paperboard may have a basis weight of from about 60 to about 330 lb/ream, for example, from about 80 to about 140 lb/ream. The paperboard generally may have a thickness of from about 6 to about 30 mils, for example, from about 12 to about 28 mils. In one particular example, the paperboard has a thickness of about 14 mils. Any suitable paperboard may be used, for example, a solid bleached sulfate board, for example, Fortress® board, commercially available from International Paper Company, Memphis, Tenn., or solid unbleached sulfate board, such as SUS® board, commercially available from Graphic Packaging International, Marietta, Ga.

The basis weight and/or caliper (i.e., thickness) of the polymer film may vary for each application. In some embodiments, the film may have a thickness of from about 12 to about 50 microns thick, for example, from about 15 to about 35 microns, for example, about 20 microns. However, other calipers are contemplated.

If desired, the susceptor film may be used in conjunction with other microwave energy interactive elements and/or structures. Structures including multiple susceptor layers are also contemplated. It will be appreciated that the use of the present susceptor film and/or structure with such elements and/or structures may provide enhanced results as compared with a conventional susceptor.

By way of example, the susceptor film may be used with a foil or high optical density evaporated material having a thickness sufficient to reflect a substantial portion of impinging microwave energy. Such elements typically are formed from a conductive, reflective metal or metal alloy, for example, aluminum, copper, or stainless steel, in the form of a solid "patch" generally having a thickness of from about 0.000285 inches to about 0.005 inches, for example, from about 0.0003 inches to about 0.003 inches. Other such elements may have a thickness of from about 0.00035 inches to about 0.002 inches, for example, 0.0016 inches.

In some cases, microwave energy reflecting (or reflective) elements may be used as shielding elements where the food item is prone to scorching or drying out during heating. In other cases, smaller microwave energy reflecting elements may be used to diffuse or lessen the intensity of microwave energy. One example of a material utilizing such microwave energy reflecting elements is commercially available from Graphic Packaging International, Inc. (Marietta, Ga.) under the trade name MicroRite® packaging material. In other examples, a plurality of microwave energy reflecting elements may be arranged to form a microwave energy distributing element to direct microwave energy to specific areas of the food item. If desired, the loops may be of a length that causes microwave energy to resonate, thereby enhancing the distribution effect. Microwave energy distributing elements are described in U.S. Pat. Nos. 6,204,492, 6,433,322, 6,552,315, and 6,677,563, each of which is incorporated by reference in its entirety.

In still another example, the susceptor film and/or structure may be used with or may be used to form a microwave energy interactive insulating material. Examples of such materials are provided in U.S. Pat. No. 7,019,271, U.S. Pat. No. 7,351,942, and U.S. Patent Application Publication No. 2008/0078759 A1, published Apr. 3, 2008, each of which is incorporated by reference herein in its entirety.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy. The breaks or apertures may extend through the entire structure, or only through one or more layers. The number, shape, size, and positioning of such breaks or apertures may vary for a particular application depending on the type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

By way of illustration, a microwave energy interactive element may include one or more transparent areas to effect dielectric heating of the food item. However, where the microwave energy interactive element comprises a susceptor, such apertures decrease the total microwave energy interactive area, and therefore, decrease the amount of microwave energy interactive material available for heating, browning, and/or crisping the surface of the food item. Thus, the relative amounts of microwave energy interactive areas and microwave energy transparent areas must be balanced to attain the desired overall heating characteristics for the particular food item.

In some embodiments, one or more portions of the susceptor may be designed to be microwave energy inactive to ensure that the microwave energy is focused efficiently on the areas to be heated, browned, and/or crisped, rather than being lost to portions of the food item not intended to be browned and/or crisped or to the heating environment.

Additionally or alternatively, it may be beneficial to create one or more discontinuities or inactive regions to prevent overheating or charring of the food item and/or the construct including the susceptor. By way of example, the susceptor may incorporate one or more "fuse" elements that limit the propagation of cracks in the susceptor structure, and thereby control overheating, in areas of the susceptor structure where heat transfer to the food is low and the susceptor might tend to become too hot. The size and shape of the fuses may be varied as needed. Examples of susceptors including such fuses are provided, for example, in U.S. Pat. No. 5,412,187, U.S. Pat. No. 5,530,231, U.S. Pat. No. 8,158,193, U.S. Patent Application Publication No. US 2012/0207885 A1, and PCT Publication No. WO 2007/127371, each of which is incorporated by reference herein in its entirety.

In the case of a susceptor, any of such discontinuities or apertures may comprise a physical aperture or void in one or more layers or materials used to form the structure or construct, or may be a non-physical "aperture". A non-physical aperture is a microwave energy transparent area that allows microwave energy to pass through the structure without an actual void or hole cut through the structure. Such areas may be formed by simply not applying microwave energy interactive material to the particular area, by removing microwave energy interactive material from the particular area, or by mechanically deactivating the particular area (rendering the area electrically discontinuous). Alternatively, the areas may be formed by chemically deactivating the microwave energy interactive material in the particular area, thereby transforming the microwave energy interactive material in the area into a substance that is transparent to microwave energy (i.e., so that the microwave energy transparent or inactive area comprises the microwave energy interactive material in an inactivated condition). While both physical and non-physical apertures allow the food item to be heated directly by the microwave energy, a physical aperture also provides a venting function to allow steam or other vapors or liquid released from the food item to be carried away from the food item.

The present invention may be understood further by way of the following examples, which are not intended to be limiting in any manner. All of the information provided represents approximate values, unless otherwise specified.

EXAMPLE 1

Various films were plasma treated and metallized in line in a standard Leybold roll to roll high vacuum vapor deposition unit equipped with a plasma pretreatment station isolated from the vapor deposition area to determine the relationship between apparent surface roughness and browning performance. The following PET films were evaluated: Mylar® 800 PET film (DuPont Teijin Films™, Hopewell, Va.), Toray 10.12 PET (Toray Films Europe, Beynost, France), Toray Lumirror® F65 PET (Toray Films USA, Kingstown, R.I.), and Terphane 19.88 (Terphane LTDA, San Paolo, Brazil). All of the samples were 48 gauge or about 12 microns in thickness.

Physical properties of the raw films (some of which were obtained from the manufacturer data sheets) are set forth in Table 1. It is noted that density measurements were performed at 25° C. in a density gradient column prepared from aqueous calcium nitrate solutions. Density values were taken after the samples had equilibrated in the column for about four hours. Values for percent crystallinity were calculated as though the samples were PET homopolymers, assuming respective amorphous and crystalline density values of 1.333 and 1.455 g/cm$^3$.

The input power (about 6 kW) was applied over a 50 inch wide film at a processing speed of 2200 fpm, so that the resulting plasma energy per unit area was about 0.041 J/cm$^2$. The plasma treatment gas was supplied at about 1 to 2 psi into a vacuum chamber held between about $10^{-4}$ and $10^{-5}$ torr. Plasma exposure time was about 1 to 2 ms. The plasma treatment equipment was of the type commercially available from Sigma Technologies International, Inc. (Tucson, Ariz.).

Immediately after plasma treatment, the films were metallized to a target optical density of about 0.20 and wound into rolls in the vacuum chamber. Controls of each film were prepared by metallizing the film at the same conditions without the plasma pretreatment.

TABLE 1

| | Thickness × $10^5$ in. | Haze % ASTM D1003 or JIS K7105 | Density g/cm$^3$ Calcium Nitrate Density Gradient Column, 4 hour Equilibration | Crystallinity % Calculated from Density | Elongation at Break MD % ASTM D822A or JIS C2151 | Elongation at Break TD % ASTM D822A or JIS C2151 |
|---|---|---|---|---|---|---|
| Mylar 800 | 48 | 2.8 | 1.398 | 53 | 110 | 90 |
| Toray 10.12 | 48 | 3.5 | 1.399 | 53.8 | 120 | 100 |
| Toray F65 | 48 | 2.0 | 1.400 | 55 | 123 | 146 |
| Terphane 19.88 | 48 | 3.0 | 1.399 | 54.1 | 130 | 110 |

| | Tensile Strength MD psi ASTM D822A or JIS C2151 | Tensile Strength TD psi ASTM D822A | Shrinkage MD % Unrestrained @ 150° C. 30 minutes | Shrinkage TD % Unrestrained @ 150° C. 30 minutes | Shrinkage MD % JIS C2151 190° C. 20 minutes | Shrinkage TD % JIS C2151 190° C. 20 minutes |
|---|---|---|---|---|---|---|
| Mylar 800 | 32,700 | 34,100 | 1.25 | 1.25 | NA | NA |
| Toray 10.12 | 29,000 | 30,450 | 1.5 | 0.3 | NA | NA |
| Toray F65 | 46,110 | 36,975 | NA | NA | 3.7 | 0.0 |
| Terphane 19.88 | 30,000 | 32,000 | 1.3 | 0.1 | 3.0 | 0.0 |

The apparent roughness of the surface, as characterized by the dimensionless parameter, perimeter divided by edge length (PEL), of each metallized film was evaluated with and without treatment as follows. Images of the surface of the metallized film were acquired using atomic force microscopy (AFM) at 0 to 100 nm full scale. Scan areas were chosen to be representative of the surfaces. A gray level histogram was generated using a gray scale from 0 to 256 units full scale light to dark using an image analysis system developed by Integrated Paper Services (IPS), Appleton, Wis. A binary image was produced at a gray scale of 120, which is equivalent to a plane intersecting the Z direction of the AFM image at 120/256*100 nm=46.9 nm or 469 angstroms in height. The total perimeter of the detected region (i.e., topographic features) was measured and normalized by the linear size of the image (i.e., the length of a single edge of the square sample area) to form a dimensionless ratio, perimeter divided by edge length (PEL), with greater perimeter divided by edge length (PEL) values indicating a rougher surface. The results are presented in Table 2. The scan data was also transformed into 3-D graphical visualizations (from a slightly raised side view perspective), as shown in FIGS. 2A-2J, in which some representative topographical features are identified and some aspect ratios of representative features are noted.

TABLE 2

| Sample/ Structure | Polymer film | Plasma treatment gas | Power (kW) | Plasma treatment energy ($J/cm^2$) | Perimeter divided by edge length (PEL) 120 | % Δ Perimeter divided by edge length (PEL) 120 | FIG. |
|---|---|---|---|---|---|---|---|
| 1 | Mylar ® 800 PET | None | None | None | 11.2 | n/a | 2E |
| 2 | Mylar ® 800 PET | Argon | 6 kw | 0.041 | 16.4 | 46.4 | 2F |
| 3 | Toray 10.12 PET | None | None | None | 6.37 | n/a | 2A |
| 4 | Toray 10.12 PET | Argon | 6kw | 0.041 | 4.31 | −32.3 | 2B |
| 5 | Toray F65 PET | None | None | None | 12.6 | n/a | 2C |
| 6 | Toray F65 PET | Argon | 6kw | 0.041 | 9.25 | −26.6 | 2D |
| 7 | Mylar ® 800 PET | None | None | None | 9.8 | n/a | 2G |
| 8 | Mylar ® 800 PET | Argon | 6 kw | 0.041 | 10.2 | 4.08 | 2H |
| 9 | Terphane 19.88 PET | None | None | None | 4.16 | n/a | 2I |
| 10 | Terphane 19.88 PET | Argon | 6 kw | 0.041 | 14.8 | 256 | 2J |

Figure 2A:
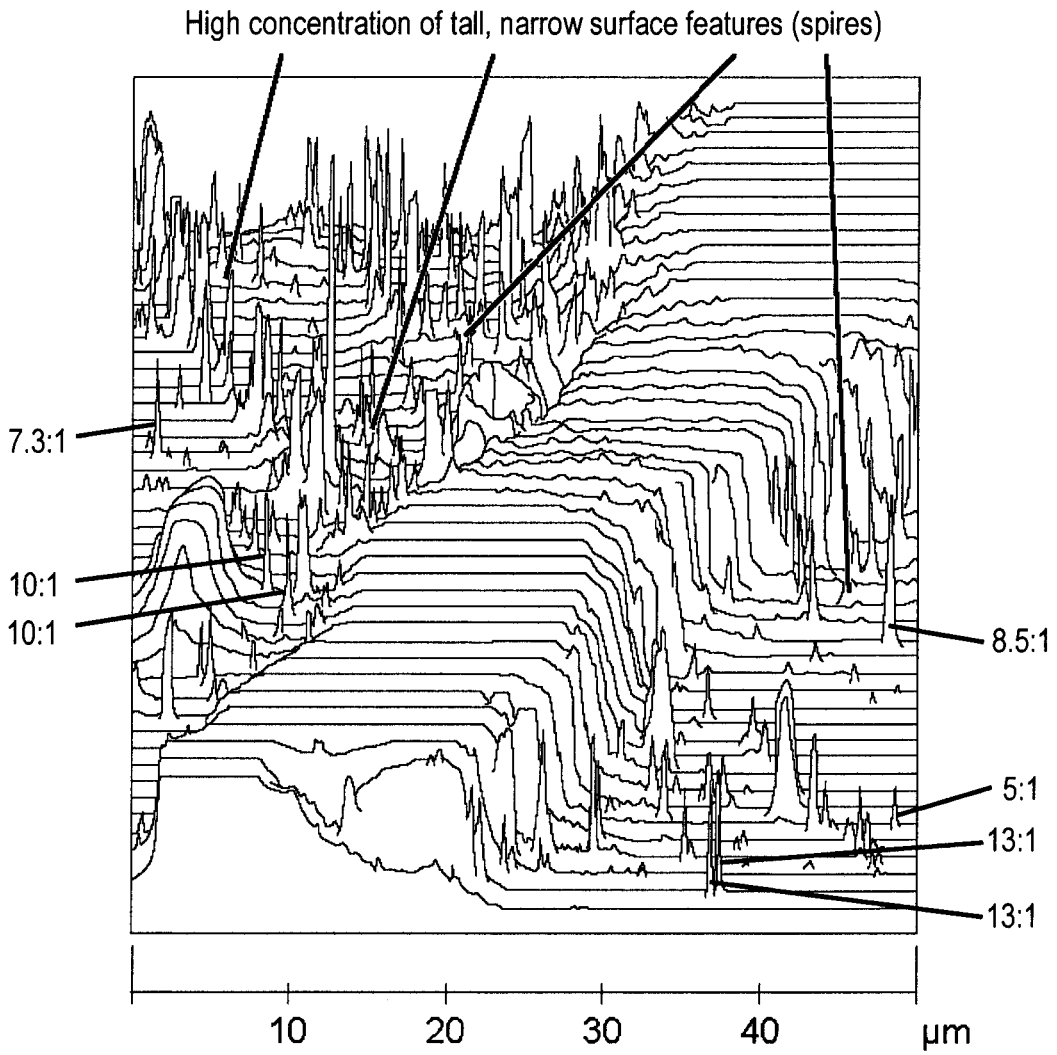
FIG. 2A is a graphic representation of the surface of a first susceptor film, prior to plasma treatment.
Figure 2B:
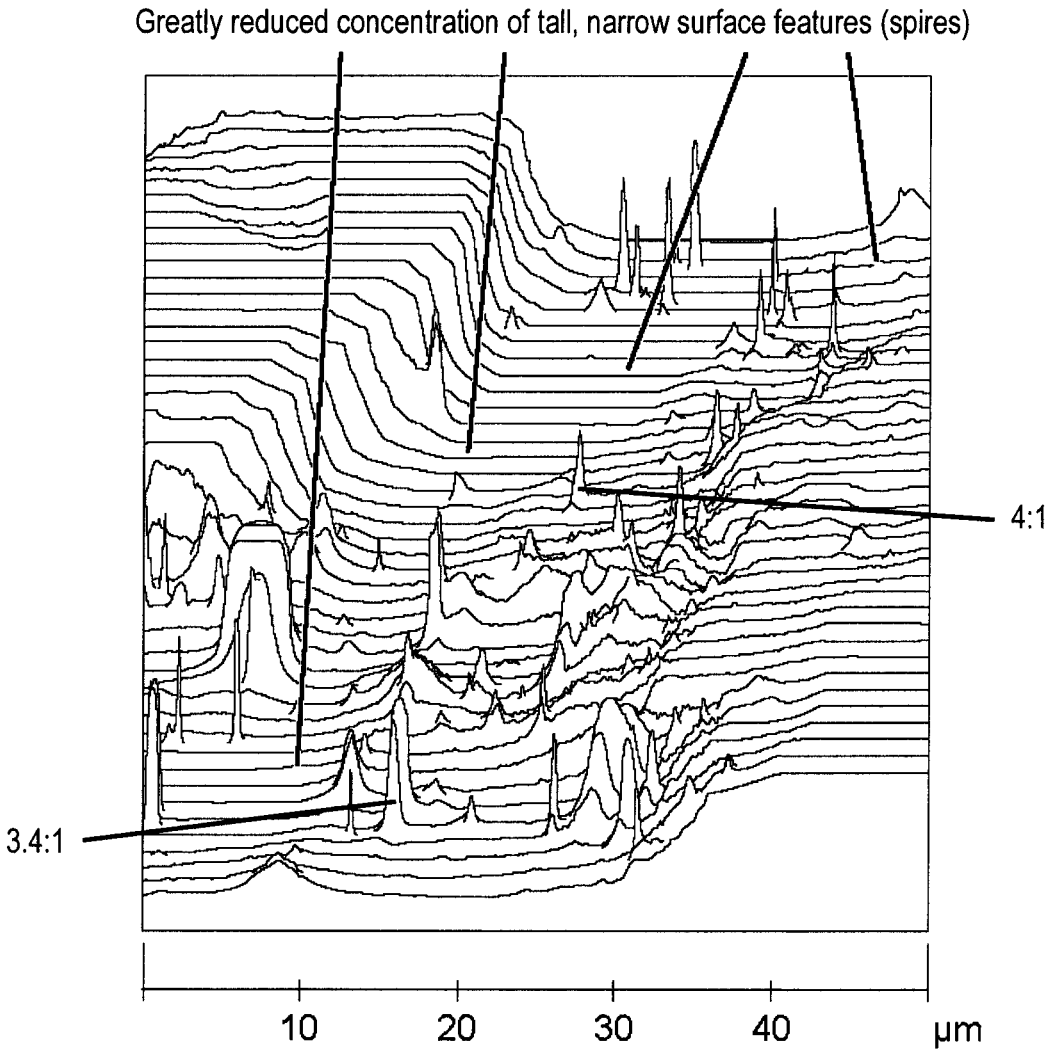
FIG. 2B is a graphic representation of the surface of the susceptor film of FIG. 2A, after plasma treatment.
Figure 2C:
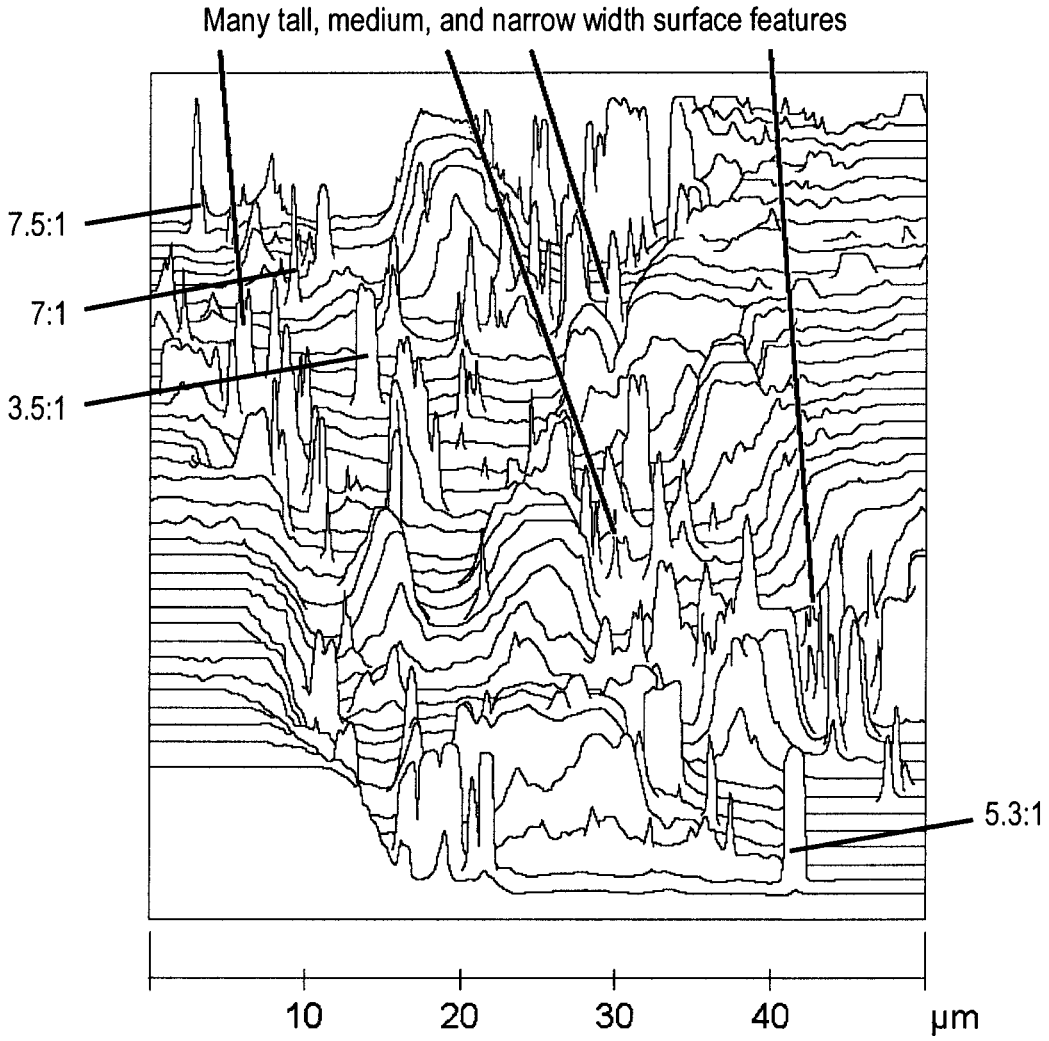
FIG. 2C is a graphic representation of the surface of a second susceptor film, prior to plasma treatment.
Figure 2D:
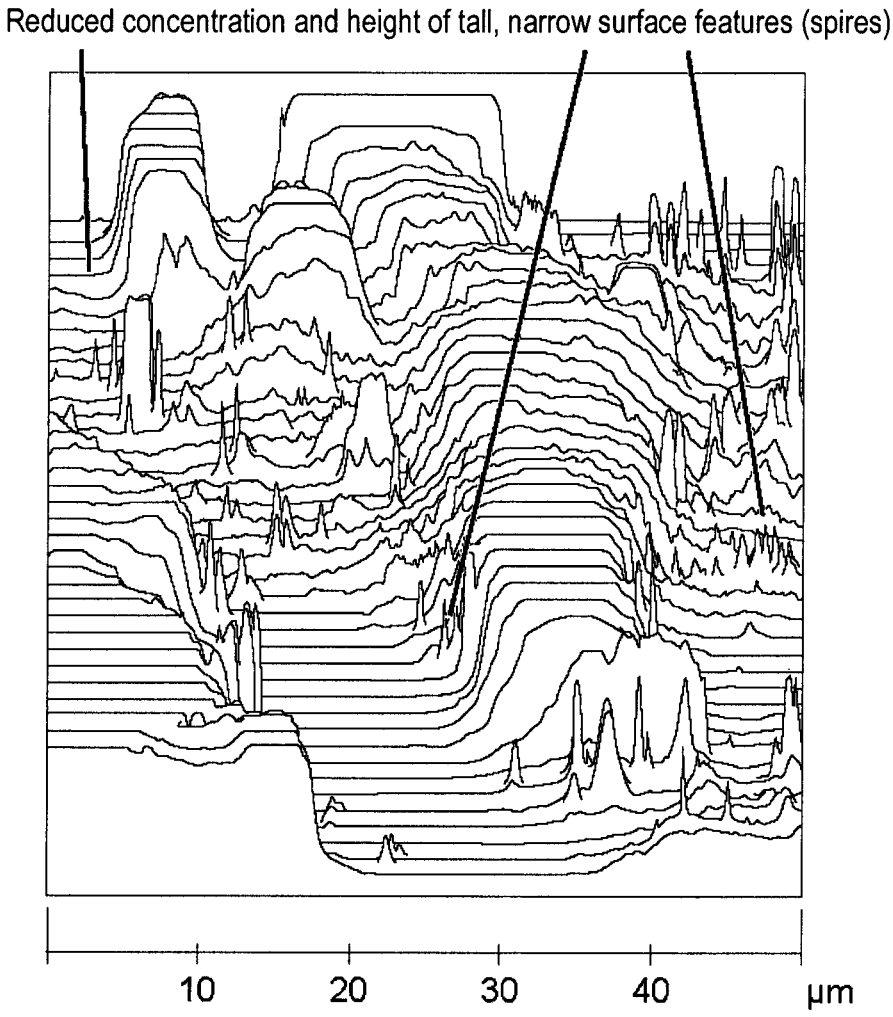
FIG. 2D is a graphic representation of the surface of the susceptor film of FIG. 2C, after plasma treatment.

FIG. 2A (Sample 3) and FIG. 2C (Sample 5) show untreated and metallized films with many high aspect ratio surface features or spires; the same base films when plasma treated under the conditions described in the specification and metallized inline immediately following treatment are presented in FIG. 2B (Sample 4) and FIG. 2D (Sample 6), respectively, and show dramatic reductions in the number and concentration of these peaks. In the case of these two films, the applied plasma treatment served to remove or erode many of these spires, resulting in a visually smoother surface after metallization, which suggests that the plasma treatment conditions (gas species, power and dwell) were well suited for reducing surface roughness for these films. When this visual evidence of change in surface roughness was quantified using the described perimeter divided by edge length (PEL) analysis technique, the change in the perimeter divided by edge length (ΔPEL) values agreed well with a qualitative examination of these 3-D visualizations.

Figure 2E:
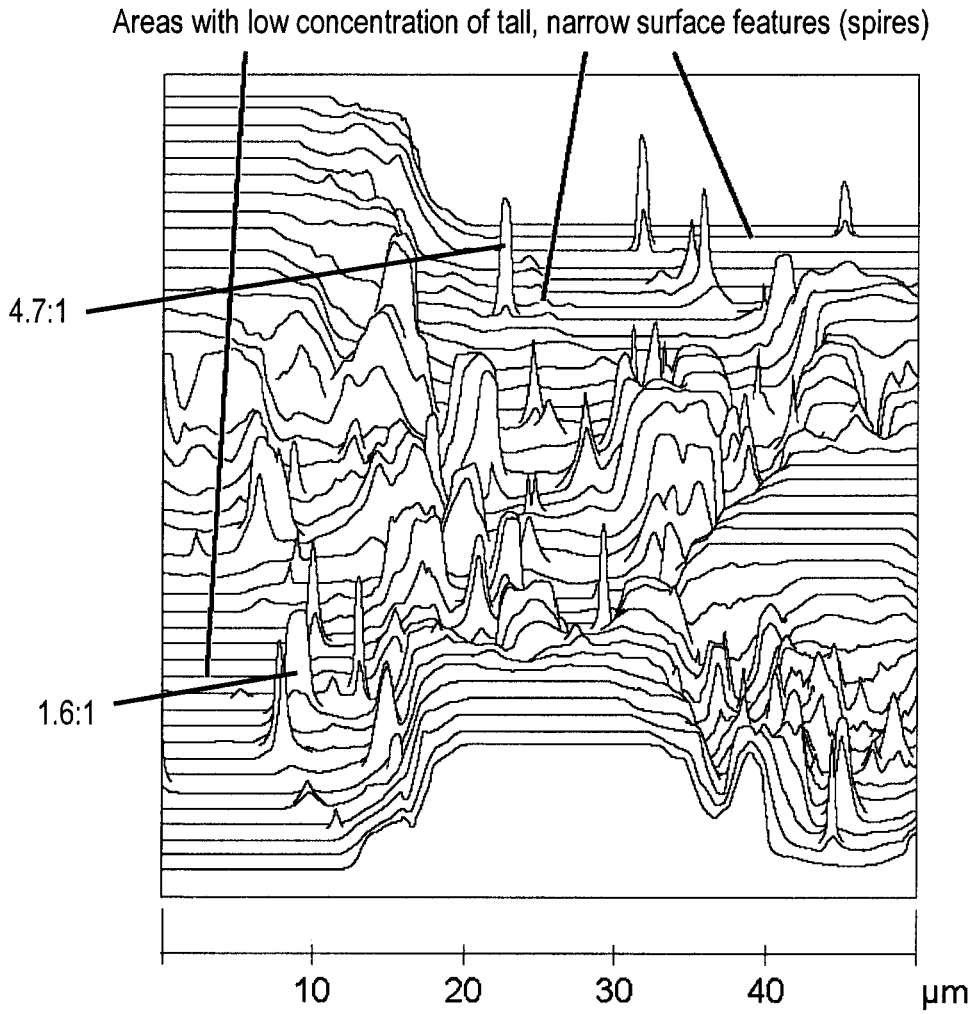
FIG. 2E is a graphic representation of the surface of a third susceptor film, prior to plasma treatment.
Figure 2F:
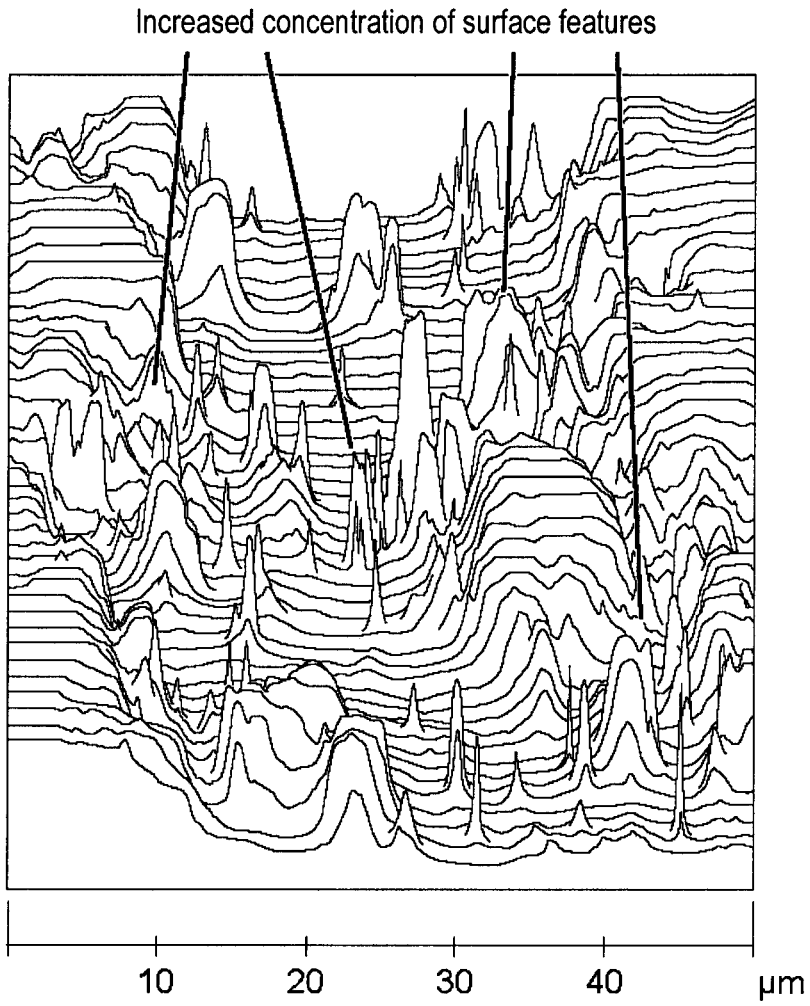
FIG. 2F is a graphic representation of the surface of the susceptor film of FIG. 2E, after plasma treatment.

Additionally, it was observed that not all films responded in the same manner to the same plasma treatment conditions. For example, for two versions of one particular film grade (Mylar® 800 PET), the number and concentration of spires was low for the untreated versions of this film, as shown in FIG. 2E (Sample 1) and FIG. 2G (Sample 7); few features with aspect ratios greater than about 5:1 are seen leaving substantial areas of the surface vulnerable to direct etching. For the metallized film that was plasma treated, surface erosion was apparent, resulting in a rougher surface, as shown in FIG. 2F (Sample 8) and FIG. 2H (Sample 2), as compared with their untreated counterparts. The modestly increased roughness from both a visual and perimeter divided by edge length (ΔPEL) parameter perspective are the result of a different response of this particular film to the plasma treatment; in the case of this film, the applied plasma treatment served to etch the amorphous portion of the film surface (and/or any grafted or crosslinked oligomers that may be present) in such a way that more surface features were created or revealed, which suggests that the plasma treatment conditions were too strong for this particular film.

A much more significant increase in roughness, both visual and as quantified by the perimeter divided by edge length (ΔPEL) value, resulted from the same plasma treatment of a different film grade, as shown in FIG. 1I (Sample 9) and FIG. 1J (Sample 10), which show the metallized surface of untreated and plasma treated variables, respectively. Sample 9 was very smooth with almost no surface features present, particularly few high aspect ratio surface features or spires. This left the film surface highly exposed to the plasma energy and resulted in significantly increased apparent surface roughness for the plasma treated metallized film. This result indicates that an even more gentle treatment would be recommended for this film.

The metallized films were then joined to 14 pt (0.014 inches thick) Fortress® board (International Paper Company, Memphis, Tenn.) using from about 1 to about 2 lb/ream (as needed) Royal Hydra Fast-en® 20123 adhesive (Royal Adhesives, South Bend, Ind.) to form susceptor structures.

Each susceptor structure was then evaluated using a pizza browning test. A Kraft Digiorno pizza was heated on each susceptor structure for about 2.5 minutes in an about 1000 W microwave oven. When the heating cycle was complete, the food item was inverted and the side of the food item heated adjacent to the susceptor (i.e., the bottom of the pizza crust) was photographed. Adobe Photoshop was used to evaluate the images. An RGB (red/green/blue) setpoint of 104/60/25 was selected to correspond to a shade of brown generally associated with a browned, crisped food item. The maximum pixel selection tolerance was chosen as the best match with visual assessments of food browning. The number of pixels having that shade was recorded, such that a greater number of pixels indicated that more browning was present.

Prior to evaluating Sample 1 (control), the unheated pizza crust was examined to determine a baseline pixel count of 24313 pixels having the color associated with the RGB value 104. This baseline value was used to calculate the results presented in Table 3, where ΔUB is the number of pixels for a pizza crust heated on a given susceptor structure minus the baseline value for an unbrowned (UB) crust (24313), and % Δ PEL is the percent change in surface roughness between the treated and untreated sample as measured by the perimeter divided by edge length (PEL) 120.

TABLE 3

| Sample/ Structure | Polymer film | Plasma treatment gas | Power (kW) | Perimeter divided by edge length (PEL) 120 | % Δ Perimeter divided by edge length (PEL) 120 | Pixels | ΔUB | FIG. |
|---|---|---|---|---|---|---|---|---|
| 1 | Mylar ® 800 PET | None | None | 11.2 | n/a | 33566 | 9253 | 2E |
| 2 | Mylar ® 800 PET | Argon | 6 kw | 16.4 | 46.4 | 31747 | 7434 | 2F |
| 3 | Toray 10.12 PET | None | None | 6.37 | n/a | 28921 | 4608 | 2A |
| 4 | Toray 10.12 PET | Argon | 6 kw | 4.31 | −32.3 | 54517 | 30204 | 2B |
| 5 | Toray F65 PET | None | None | 12.6 | n/a | 37140 | 12827 | 2C |
| 6 | Toray F65 PET | Argon | 6 kw | 9.25 | −26.6 | 47469 | 23156 | 2D |
| 7 | Mylar ® 800 PET | None | None | 9.8 | n/a | 44401 | 20088 | 2G |
| 8 | Mylar ® 800 PET | Argon | 6 kw | 10.2 | 4.08 | 42812 | 18499 | 2H |
| 9 | Terphane 19.88 PET | None | None | 4.16 | n/a | 40788 | 16475 | 2I |
| 10 | Terphane 19.88 PET | Argon | 6 kw | 14.8 | 256 | 34031 | 9718 | 2J |

The results confirm that different polymer films will react differently to plasma treatment, with the different films tested separating themselves into two distinct response groups. Samples 3 and 5 (untreated Toray 10.12 and untreated Toray F65) both responded to the plasma treatment to yield plasma treated Samples 4 and 6, respectively, that showed reduced apparent surface roughness and increased pizza crust browning compared to their untreated predecessors.

Untreated Samples 1 and 7 (DuPont Mylar® 800 PET film from different product lots) and untreated Sample 9 (Terphane 19.88) responded to the same plasma treatment applied to the other group (untreated Samples 3 and 5) to yield plasma treated Samples 2, 8 and 10, respectively, that showed increased apparent surface roughness and reduced pizza crust browning compared to their untreated counterparts.

These different responses occurred despite the films having different starting apparent surface roughness, as characterized by the dimensionless perimeter divided by edge length (PEL) 120 parameter; untreated Sample 9 had the lowest initial roughness and resulting treated Sample 10 had one of the highest treated film roughness values. On the other hand, untreated Sample 3, with the second lowest initial roughness responded to yield treated Sample 4, with the lowest absolute perimeter divided by edge length (PEL) surface roughness. Of the highest untreated film roughness samples, 1, 5 and 7, Samples 1 and 7's corresponding treated Samples 2 and 8 showed differing roughness increases while Sample 5's corresponding treated Sample 6 showed reduced roughness. For this Example, metallized surface roughness of the untreated samples was not a predictor of the metallized surface roughness of the treated samples.

Sample 4, which had the lowest absolute apparent surface roughness value, as characterized by perimeter divided by edge length (PEL) 120 values, of all treated samples, also exhibited the best ability to provide pizza browning increases.

Figure 3:
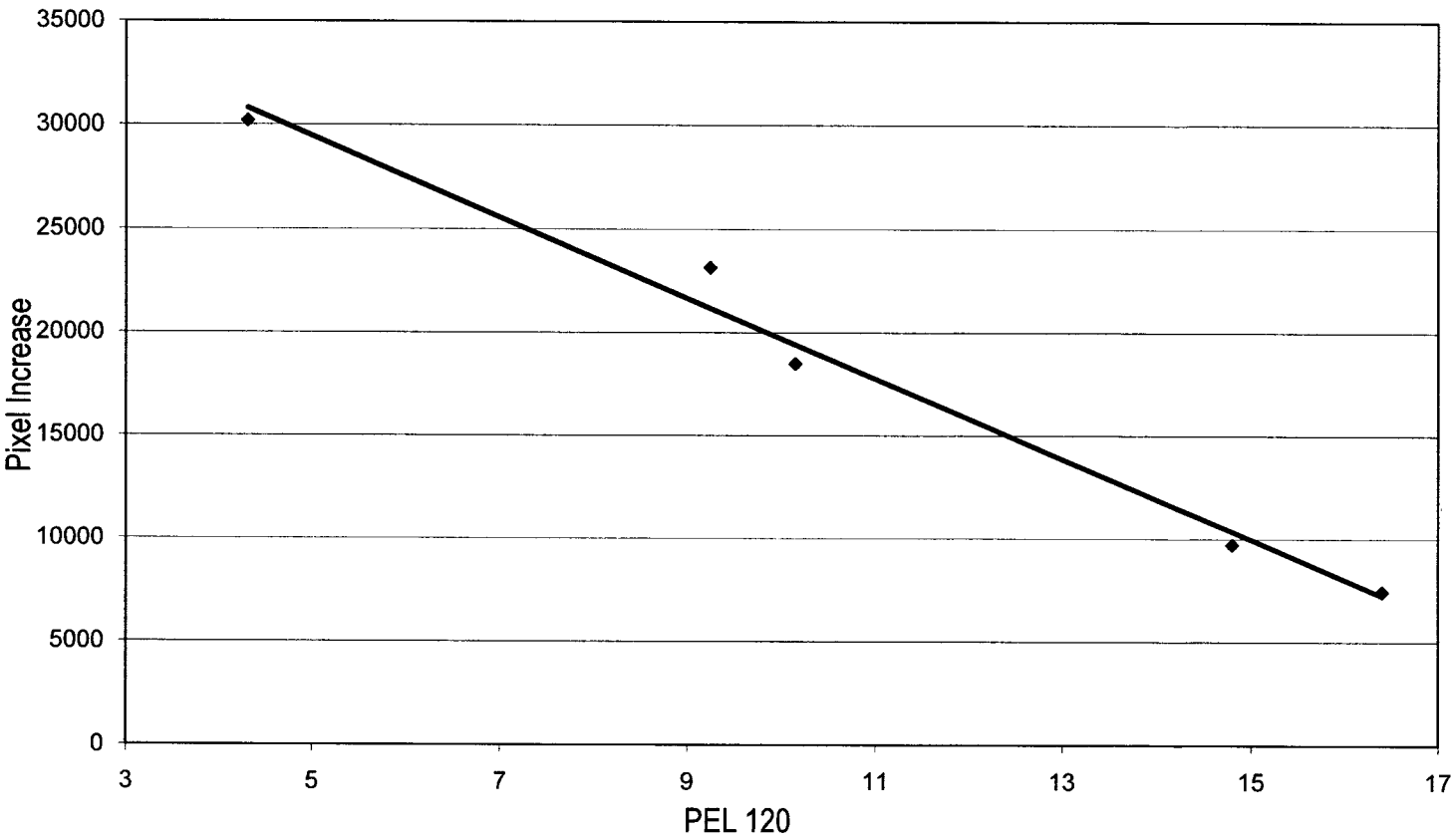
FIG. 3 is a plot of pixel increase (increase in pizza crust browning) vs. apparent surface roughness (as characterized using the dimensionless parameter, perimeter divided by edge length, or PEL 120) for the various plasma treated film samples.

FIG. 3 is a plot of pixel increase (increase in pizza crust browning) vs. apparent surface roughness, as characterized by perimeter divided by edge length (PEL) 120 values, for the five plasma treated film samples (Samples 2, 4, 6, 8, and 10). These properties correlate at an r-squared coefficient of 98.5%, indicating a very strong correlation between surface roughness of plasma treated films and pizza crust browning capability.

Figure 4:
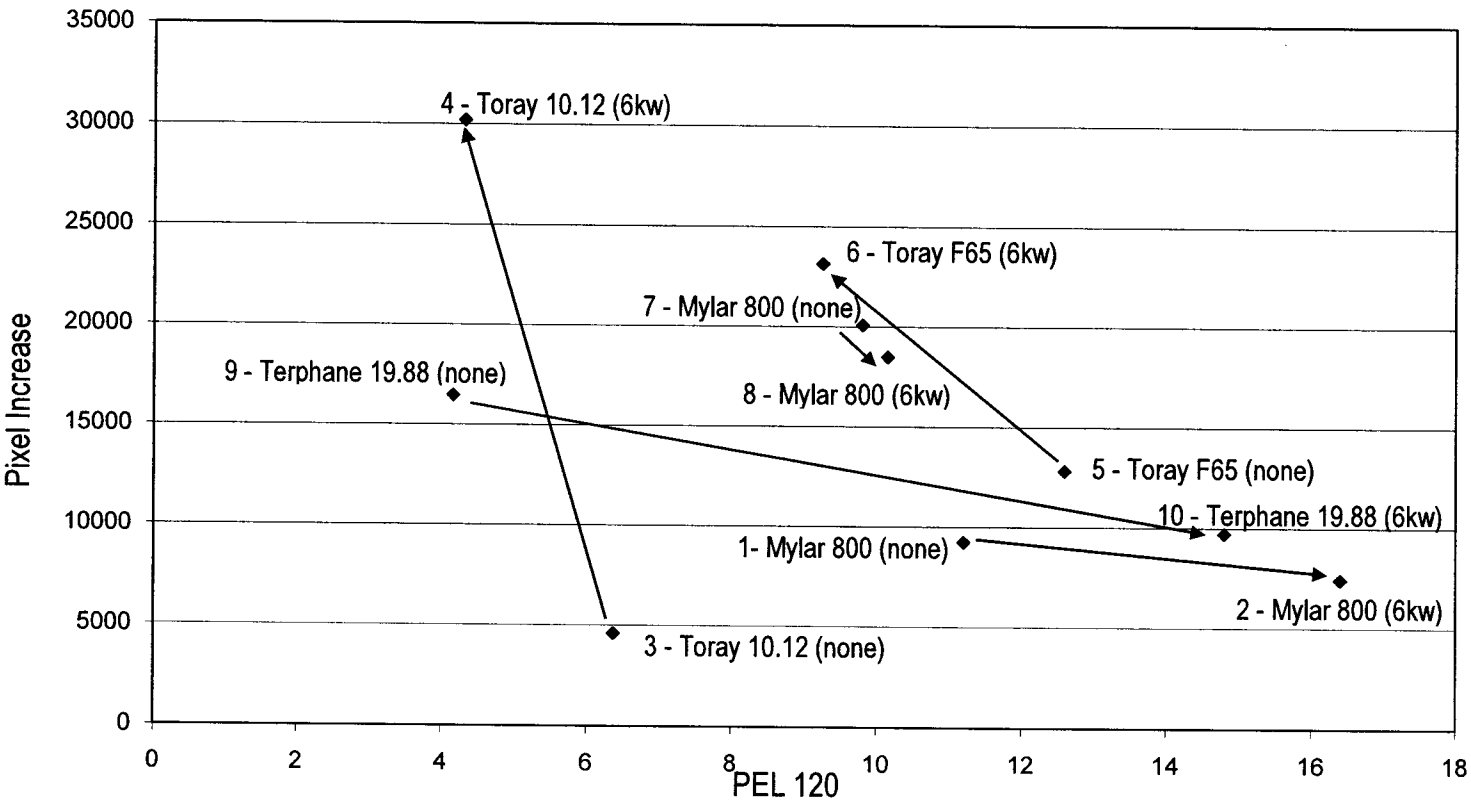
FIG. 4 is a plot of pixel increase (increase in pizza crust browning) vs. apparent surface roughness (as characterized using the dimensionless parameter, perimeter divided by edge length, or PEL 120) for the various untreated and plasma film samples, with arrows connecting the data points for the corresponding untreated and plasma treated sample pairs.

FIG. 4 depicts the data points for the untreated film samples (Samples 1, 3, 5, 7, and 9), with arrows connecting the data points for the corresponding treated and untreated sample pairs. Notably, it was determined that there is a strong correlation between the perimeter divided by edge length (PEL) value for a particular metallized film with plasma pre-treatment and its ability to brown and crisp an adjacent food item when incorporated into a susceptor structure.

The metallized films that exhibited a decrease in the perimeter divided by edge length (PEL) value after plasma treatment (in this case, with argon) at low pressure (e.g., between about $5\times10^{-4}$ and $1\times10^{-5}$ torr) showed an improvement in browning and crisping performance (with points 3 and 4 indicating the change in performance of the Toray 10.12 PET film shown in FIGS. 2A and 2B, and points 5 and 6 indicating the change in performance of the Toray F65 PET film shown in FIGS. 2C and 2D).

Figure 2G:
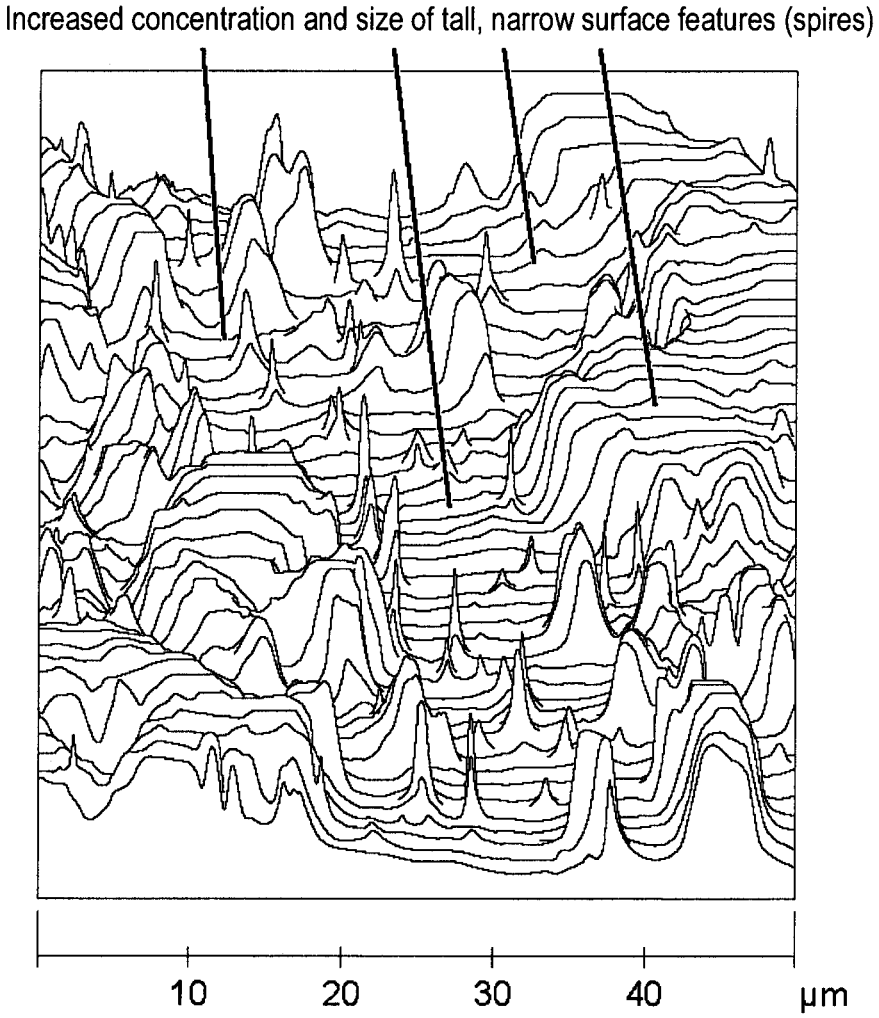
FIG. 2G is a graphic representation of the surface of a fourth susceptor film, prior to plasma treatment.
Figure 2H:
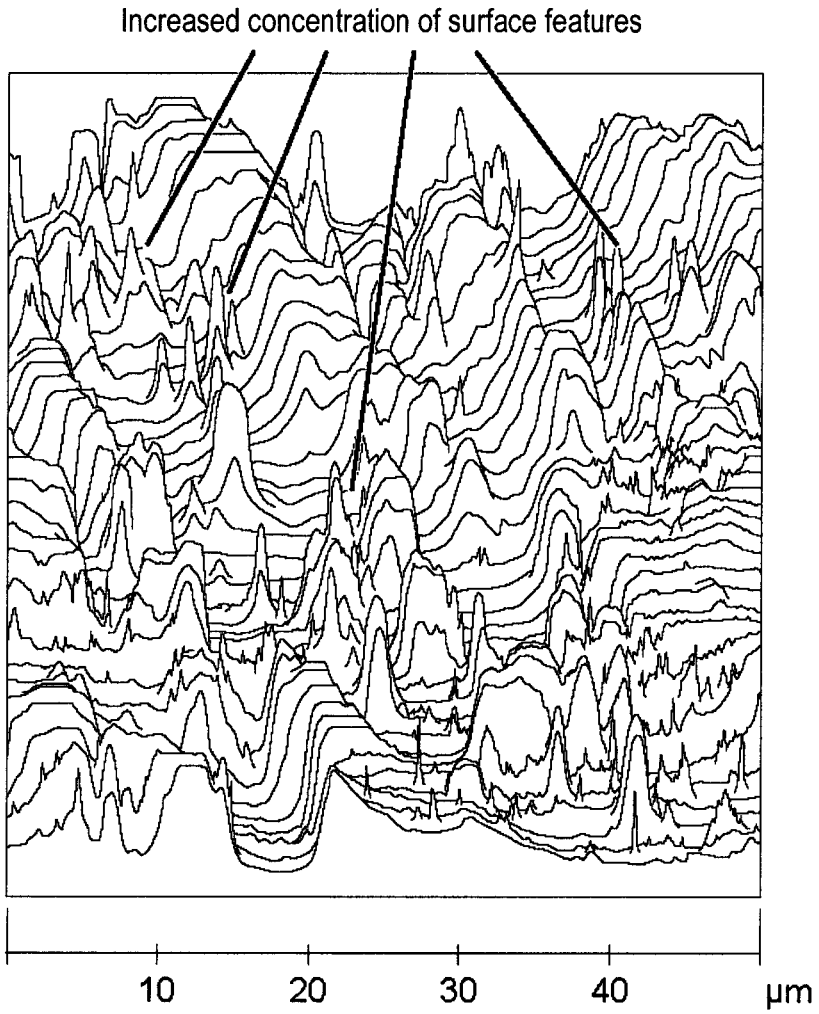
FIG. 2H is a graphic representation of the surface of the susceptor film of FIG. 2G, after plasma treatment.
Figure 2I:
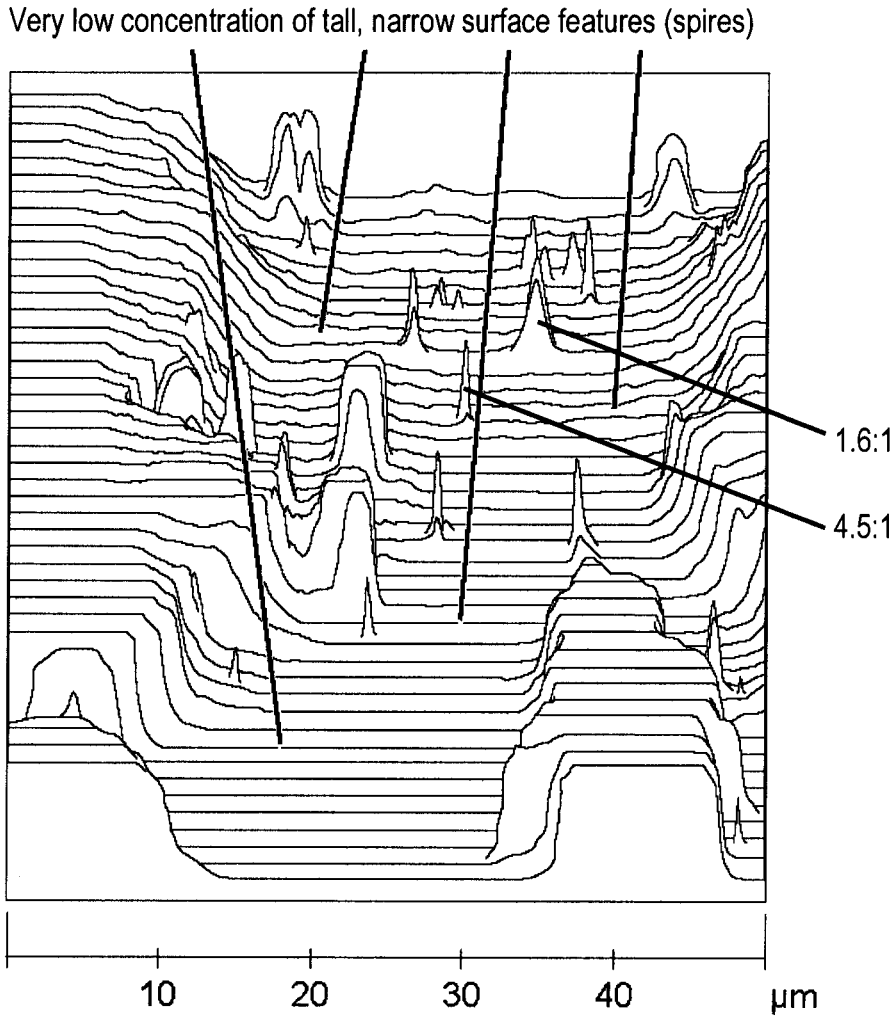
FIG. 2I is a graphic representation of the surface of a fifth susceptor film, prior to plasma treatment.
Figure 2J:
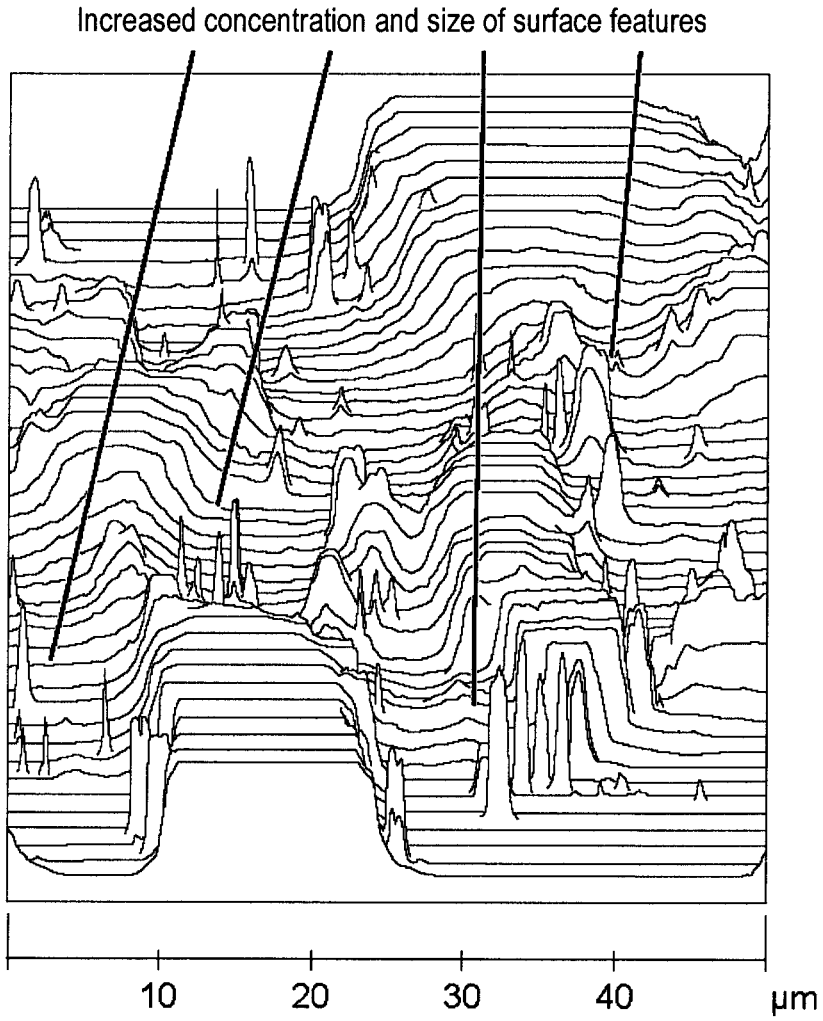
FIG. 2J is a graphic representation of the surface of the susceptor film of FIG. 2I, after plasma treatment.

Conversely, the metallized films that exhibited an increase in the perimeter divided by edge length (PEL) value after plasma treatment showed a modest reduction in browning and crisping performance (with points 7 and 8 indicating the change in performance of the DuPont 800 PET film shown in FIGS. 2E and 2F, points 1 and 2 indicating the change in performance of a different version of DuPont 800 PET film shown in FIGS. 2G and 2H, and points 9 and 10 indicating the change in performance of Terphane 19.88 PET film shown in FIGS. 1I and 1J). As stated above, starting roughness was not a determinant of final roughness, but the data points for all the treated films nonetheless fell on a line showing a linear inverse relationship between the perimeter divided by edge length (PEL) 120 value and pixel increase, as shown in FIG. 3.

As stated above, this strong correlation between the perimeter divided by edge length (PEL) value for a particular plasma treated metallized film and its ability to brown and crisp an adjacent food item when incorporated into a susceptor structure, as shown in FIG. 3, can be used to predict how a particular plasma treated metallized film will perform in a susceptor structure. Without wishing to be bound by theory, it is believed that this data clearly show that pizza crust browning, a practical measure of the heating ability of a susceptor structure, is far more strongly related to surface smoothness for plasma treated films than for untreated films. This indicates that in addition to surface smoothing, the surface activation and/or chemical modification that occurs during a given plasma treatment acts to reduce differences in surface receptivity to susceptor deposition between different untreated films, yielding treated films for which their food heating capability can be predicted by apparent surface roughness.

EXAMPLE 2

Samples of DuPont Mylar® 800 PET were exposed to plasmas under various conditions using nitrogen (N2) or a mixture of argon (Ar) and nitrogen as the plasma treatment gas, as set forth in Table 4. The input power (about 4 kW or about 6 kW) was applied over a 50 inch wide film at a processing speed of 2200 fpm, such that the resulting plasma energy per unit area was about 0.027 J/cm$^2$ (about 25 J/sq. ft.) or about 0.041 J/cm$^2$ (about 38 J/sq. ft). Pizza browning testing was conducting as described in Example 1. The results are presented in Table 4, where % A Control is the change in pixel increase for a pizza heated on the given structure compared with the pixel increase for a pizza heated on control structure (Structure 1 from Example 1). Apparent surface roughness data, as characterized using the perimeter divided by edge length (PEL) 120 parameter, was not available.

The results generally indicate that the optimum susceptor structure performance for susceptor films produced with plasma pretreatment will vary in terms of not only the chosen gas or gas mixture, but also with the applied power level of the plasma. The optimum combination of these process variables must be determined for each film grade by experimentation.

For example, for Mylar® 800 PET, a structure made with plasma treated film using nitrogen at 4 kW (Structure 11) outperformed both the control structure (Structure 1) and a structure made with plasma treated film using nitrogen at 6 kW (Structure 12). Structures 13 and 14, which were plasma treated using 80/20 mixture of argon and nitrogen showed a decrease in pizza browning.

This is not surprising, given that one would expect an 80/20 mixture of argon and nitrogen to produce results that are similar to plasma treatment using only argon, which resulted in an increase in polymer film roughness and a decrease in pizza browning for this particular film (see Samples/Structures 2 and 8 in Example 1). The fact that Sample 11 in Table 4 showed increased food browning performance with a combination of a different gas species and lower applied plasma power than the power used for Samples 2 and 8 in Example 1 (Table 1) which both decreased in food browning performance reinforces the need to tailor for individual films the gentler plasma exposure of this invention than the levels previously investigated.

TABLE 4

| Sample/ Structure | Polymer film | Plasma treatment gas | Power (kW) | Pixels | ΔUB | % Δ Control |
|---|---|---|---|---|---|---|
| 1 | Mylar ® 800 PET | None | None | 33566 | 9253 | n/a |
| 11 | Mylar ® 800 PET | N2 | 4 | 50561 | 26248 | 184 |
| 12 | Mylar ® 800 PET | N2 | 6 | 32100 | 7787 | −16 |
| 13 | Mylar ® 800 PET | 80/20 Ar/N2 | 4 | 25545 | 1232 | −87 |
| 14 | Mylar ® 800 PET | 80/20 Ar/N2 | 6 | 26347 | 2034 | −78 |

While the present invention is described herein in detail in relation to specific aspects and embodiments, it is to be understood that this detailed description is only illustrative and exemplary of the present invention and is made merely for purposes of providing a full and enabling disclosure of the present invention and to set forth the best mode of practicing the invention known to the inventors at the time the invention was made. The detailed description set forth herein is illustrative only and is not intended, nor is to be construed, to limit the present invention or otherwise to exclude any such other embodiments, adaptations, variations, modifications, and equivalent arrangements of the present invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other. Further, various elements discussed with reference to the various embodiments may be interchanged to create entirely new embodiments coming within the scope of the present invention.

What is claimed is:

1. A method of making a microwave energy interactive structure, comprising:

providing a polymer film, wherein the polymer film comprises polyethylene terephthalate;

plasma treating the surface of the polymer film with a plasma treatment gas comprising at least one of nitrogen and argon, wherein plasma treating the surface of the polymer film comprises exposing the surface of the polymer film to the plasma treatment gas at a plasma energy per unit surface area of less than about 0.2 J/cm$^2$; and thereafter depositing a layer of microwave energy interactive material onto the plasma treated surface of the polymer film in a chamber having a pressure of less than about $5\times10^{-4}$ torr, wherein the layer of microwave energy interactive material is operative for converting at least a portion of impinging microwave energy into thermal energy.

2. The method of claim 1, wherein plasma treating the surface of the polymer film comprises exposing the surface of the polymer film to the plasma treatment gas at a plasma energy per unit surface area of less than about 0.1 J/cm$^2$.

3. The method of claim 1, wherein plasma treating the surface of the polymer film comprises exposing the surface of the polymer film to the plasma treatment gas at a plasma energy per unit surface area of less than about 0.05 J/cm$^2$.

4. The method of claim 1, wherein the polymer film is exposed to the plasma treatment gas for less than about 3 ms.

5. A method of making a microwave energy interactive structure, comprising:

providing a polymer film, wherein the polymer film has a surface with an apparent surface roughness;

plasma treating the surface of the polymer film with a plasma treatment gas at a plasma treatment energy per unit surface area of the polymer film of from about 0.005 J/cm$^2$ to about 0.2 J/cm$^2$, wherein plasma treating the surface of the polymer film reduces the apparent surface roughness of the surface of the polymer film; and depositing a layer of microwave energy interactive material onto the surface of the polymer film, wherein the layer of microwave energy interactive material is operative for converting at least a portion of impinging microwave energy into thermal energy.

6. The method of claim 5, wherein the plasma treatment gas comprises at least one of argon or nitrogen, and the plasma treatment energy per unit surface area of the polymer film is from about 0.01 $J/cm^2$ to about 0.1 $J/cm^2$.

7. The method of claim 5, wherein the apparent surface roughness of the polymer film is at least partially attributable to surface features having an aspect ratio of at least about 5:1, and plasma treating the surface of polymer film reduces the height of the surface features.

8. The method of claim 5, wherein plasma treating the surface of the polymer film reduces the apparent surface roughness of the polymer film about 20% to about 50%.

9. The method of claim 5, wherein plasma treating the surface of the polymer film reduces the apparent surface roughness of the polymer film about 25% to about 35%.

10. The method of claim 5, further comprising joining a support layer to the layer of microwave energy interactive material such that the layer of microwave energy interactive material is disposed between the polymer film and the support layer.

11. The method of claim 10, wherein the support layer comprises paper, paperboard, or any combination thereof.

12. A method of making a microwave energy interactive structure, comprising:

plasma treating a surface of a polymer film at a plasma energy per unit surface area of less than about 0.2 $J/cm^2$ with an exposure time of less than about 3 ms, wherein the surface of the polymer film has a topography defined at least partially by surface structures;

depositing a layer of microwave energy interactive material onto the plasma treated surface of the polymer film to form a susceptor film, wherein a total perimeter of surface structures within a square sample area divided by an edge length of the square sample area defines a PEL value of the susceptor film, and plasma treating the surface of the polymer film reduces the PEL value of the susceptor film;

and joining the susceptor film to a dimensionally stable substrate to form the microwave energy interactive structure, wherein the layer of microwave energy interactive material is operative for converting microwave energy into thermal energy so that the susceptor film heats to a maximum temperature, and reducing the PEL value of the susceptor film by plasma treating the surface of the polymer film increases the maximum temperature of the susceptor film when exposed to microwave energy.

13. The method of claim 12, further comprising positioning a food item having a surface that is desirably at least one of browned and crisped so that the surface of the food item is proximate to the susceptor film of the microwave energy interactive structure, and exposing the food item and microwave energy interactive structure to microwave energy so that the layer of microwave energy interactive material converts at least a portion of the microwave energy into thermal energy and at least one of browns and crisps the surface of the food item, wherein the microwave energy interactive structure at least one of browns and crisps the surface of the food item to a greater extent relative to the microwave energy interactive structure without plasma treating the polymer film.

14. A method of making a microwave energy interactive structure, comprising:

plasma treating a surface of a polymer film under vacuum using an inert gas at a plasma energy per unit surface area of less than about 0.2 $J/cm^2$, wherein the surface of the polymer film has an apparent surface roughness defined at least partially by surface structures having various heights; and thereafter depositing a layer of microwave energy interactive material onto the plasma treated surface of the polymer film to form a susceptor film, wherein a total perimeter of surface structures within a square sample area divided by an edge length of the square sample area defines a PEL value of the susceptor film, and plasma treating the surface of the polymer film reduces the height of at least some of the surface structures at least about 20%, so that the PEL value of the susceptor film is reduced from a first PEL value to a second PEL value, and wherein the layer of microwave energy interactive material is operative for converting microwave energy into heat so that the susceptor film reaches a maximum temperature, and the maximum temperature of the susceptor film is greater for the susceptor film having the second PEL value than for a susceptor film having the first PEL value.

* * * * *